US006638697B2

(12) United States Patent
Ishikawa et al.

(10) Patent No.: US 6,638,697 B2
(45) Date of Patent: Oct. 28, 2003

(54) METHOD OF PROCESSING SILVER HALIDE COLOR PHOTOGRAPHIC MATERIALS

(75) Inventors: Takatoshi Ishikawa, Minami-Ashigara (JP); Tetsuro Kojima, Minami-Ashigara (JP); Masaru Yoshikawa, Minami-Ashigara (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 08/554,939

(22) Filed: Nov. 9, 1995

(65) Prior Publication Data

US 2002/0192604 A1 Dec. 19, 2002

(30) Foreign Application Priority Data

Nov. 10, 1994 (JP) ..... 6-300103

(51) Int. Cl.[7] ..... G03C 7/42

(52) U.S. Cl. ..... 430/393; 430/455; 430/459; 430/460

(58) Field of Search ..... 430/393, 455, 430/459, 460

(56) References Cited

U.S. PATENT DOCUMENTS

| | | | | |
|---|---|---|---|---|
| 4,939,075 A | | 7/1990 | Bergthaller et al. | 430/460 |
| 5,120,635 A | * | 6/1992 | Sasaki et al. | 430/393 |
| 5,298,370 A | * | 3/1994 | Kojima et al. | 430/393 |
| 5,401,621 A | | 3/1995 | Kojima et al. | 430/393 |
| 5,415,983 A | | 5/1995 | Kojima et al. | 430/455 |
| 5,543,272 A | * | 8/1996 | Kojima et al. | 430/455 |

FOREIGN PATENT DOCUMENTS

| | | | |
|---|---|---|---|
| EP | 0 513 766 A2 | * | 11/1992 |
| EP | 0 513 766 A3 | * | 1/1993 |
| JP | 01063960 A | | 3/1989 |
| JP | 0 4337729 A | * | 11/1992 |
| JP | 05080450 A | | 4/1993 |

* cited by examiner

*Primary Examiner*—Hoa Van Le
(74) *Attorney, Agent, or Firm*—Burns, Doane, Swecker & Mathis, LLP

(57) ABSTRACT

A method of processing a silver halide color photographic material comprises the steps of color-developing an image-wise exposed silver halide color photographic material and subjecting the developed material to desilvering in a processing bath having a fixing function and containing a thiosulfate compound and the following compound or analogue thereof in a molar ratio of 1/0.05 to 1/0.30. In this process, the fixing speed is extremely high even when the replenishing rate is low and the processed photosensitive material has an excellent resistance to fading by light.

11 Claims, No Drawings

METHOD OF PROCESSING SILVER HALIDE COLOR PHOTOGRAPHIC MATERIALS

BACKGROUND OF THE INVENTION

The present invention relates to a method of processing a silver halide color photosensitive photographic material. In particular, the present invention provides a method wherein the fixing speed is extremely high even when the replenishing rate is low and the processed photosensitive material has excellent resistance to fading by light.

Usually the method of processing silver halide color photographic materials comprises the steps of color development, silver removal, washing with water and/or stabilization. In the step of removing silver, the developed silver formed in the color development step is oxidized (bleached) with a bleaching agent having an oxidizing effect to form a silver salt and then the silver salt is removed from the photosensitive layer together with the unused silver halide with a fixing agent capable of forming the soluble silver (fixing).

The bleaching and fixing may be conducted independently from each other in the bleaching step and fixing step, respectively, or they may be conducted at the same time in a bleach-fixing step. The detailes of these processing steps are described in James, "The Theory of Photograhic Process" 4th edition (1977).

In the respective steps, a replenisher which is a solution having a high activity is usually supplemented into the processing solution in the tank in order to keep the processing capacity. By the supplementation, the tank solution is usually discharged as a so-called "overflow".

As the environmental pollution of the earth is now being a problem, a measure against the problem caused by the waste solution must be taken as a matter of course. The best method is to reduce the quantity of the waste solution as far as posible. The easiest method for reducing the amount of the waste solution is supposed to be the reduction in amount of the above-described replenisher. However, it has been found that when the amount of the replenisher to be fed into the bath having the fixing function is simply reduced in the present invention, the fixing capacity is seriously impaired and the fading of the processed photosensitive material by light is also seriously accelerated by an influence of accumulated components (such as iodine ion and silver ion dissolved out of the photosensitive material).

It is known that this problem also occurs when a thiosulfate radical which is a usual fixing agent is used or when the thiosulfate radical is replaced with a meso-ionic compound described in Japanese Patent Unexamined Published Application (hereinafter referred to as "J. P. KOKAI") Nos. Hei 4-143757, 4-143765 and 4-143755. Thus, it has been demanded to solve this problem.

SUMMARY OF THE INVENTION

Therefore, the primary object of the present invention is to provide a method of processing a silver halide color photographic material with a processing composition having an excellent fixing function.

Another object of the present invention is to provide a processing process capable of providing the product having an excellent resistance to fading by light.

These and other objects of the present invention will be apparent from the following description and examples.

After intensive investigations, the inventors have found that the above-described objects can be attained by a method of processing a silver halide color photographic material which comprises the steps of color-developing an image-wise exposed silver halide color photographic material and subjecting the developed material to desilvering in a processing bath having a fixing function and containing a thiosulfate compound and a compound of the following general formula (I) in a molar ratio of 1/0.05 to 1/0.30:

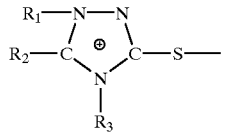

(I)

wherein $R_1$, $R_2$ and $R_3$ each represent a hydrogen atom or an alkyl, cycloalkyl, alkenyl, alkynyl, aralkyl, aryl, heterocyclic, amino, acylamino, sulfonamido, ureido, sulfamoylamino, acyl, thioacyl, carbamoyl or thiocarbamoyl group, with the proviso that at least one of $R_1$, $R_2$ and $R_3$ is an alkyl group substituted with a water-soluble group and that both $R_1$ and $R_3$ cannot be hydrogen atom at the same time.

The compounds of the above general formula (I) are called "meso-ionic compounds", which are illustrated as stable fixing agents usable as a substitute for the thiosulfate radical in J. P. KOKAI Nos. Hei 4-143757, 4-143765 and 4-143755 and also as bleaching accelerators in J. P. KOKAI No. Hei 1-201659. However, the inventors have found that when the quantity of the replenisher to be fed into the bath having the fixing function is reduced, the iodine ion is accumulated to cause problems that the fixing capacity is reduced and that the photosensitive material cannot be prevented from fading by light. It was not supposed at all prior to the present invention that the fixing speed can be remarkably increased even under these conditions by using the combination of the thiosulfate radical and a specified meso-ionic compound having a high solubility in water in a specified ratio.

DESCRIPTION OF THE PREFERRED EMBODIMENTS

The detailed description will be made on the compounds of the general formula (I) used in the present invention.

The alkyl, cycloalkyl, alkenyl, alkynyl, aralkyl and aryl groups of $R_1$, $R_2$ and $R_3$ preferably have 1 to 10 carbon atoms. Each of $R_1$, $R_2$ and $R_3$ is particularly preferably a hydrogen atom or alkyl group having 1 to 5 carbon atoms. These groups may be substituted with a substituent. Preferred substituents include hydroxyl group, amino group, sulfonic acid group, carboxylic acid groups, nitro group, phosphoric acid group, halogen atoms, alkoxy groups, mercapto group, cyano group, alkylthio groups, sulfonyl group, carbamoyl group, carbonamido group, sulfonamido group, acyloxy groups, sulfonyloxy group, ureido group and thioureido group. At least one of $R_1$, $R_2$ and $R_3$ must be an alkyl group substituted with a water-soluble group. Examples of the water-soluble groups herein include hydroxyl group, amino group, sulfonic acid group, carboxylic acid groups and phosphoric acid groups. Among them, sulfonic acid and carboxylic acid groups are preferred. The alkyl groups have preferably 1 to 4 carbon atoms. If necessary, $R_1$, $R_2$ and $R_3$ may have two or more substituents.

Examples of the compounds usable in the present invention are given below, which by no means limit the invention.

I-1
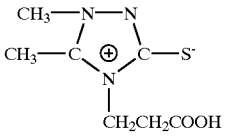
I-2
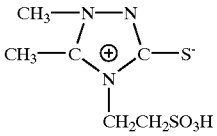
I-3
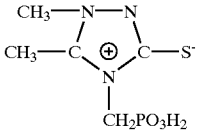
I-4
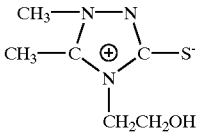
I-5
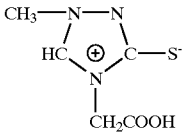
I-6
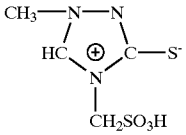
I-7
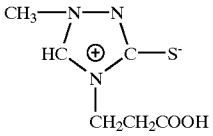
I-8
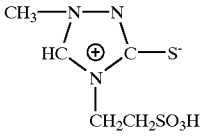
I-9
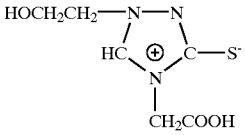
I-10
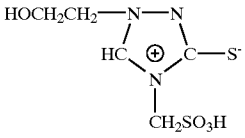
I-11
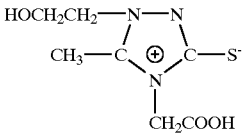
-continued
I-12
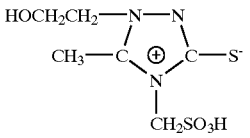
I-13
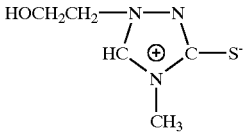
I-14
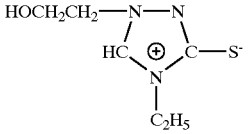
I-15
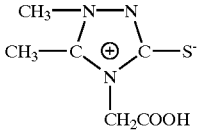
I-16
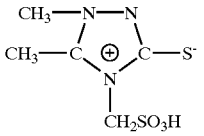
I-17
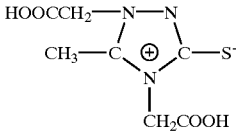
I-18
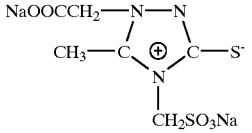
I-19
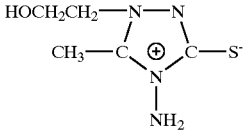
I-20
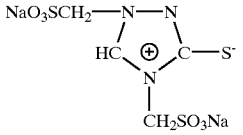
I-21
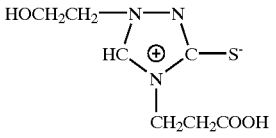

-continued
I-22
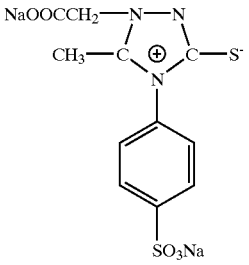
I-23
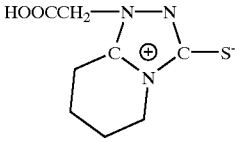
I-24
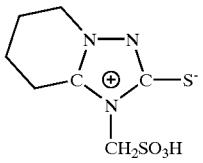
I-25
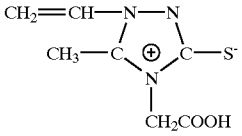
I-26
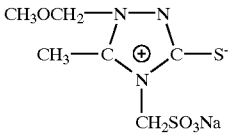
I-27
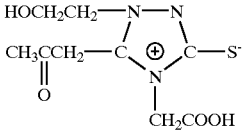
I-28
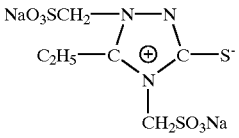
I-29
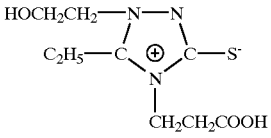
I-30
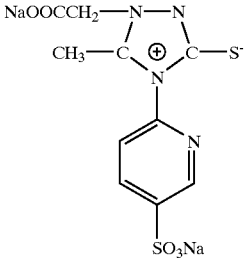
-continued
I-31
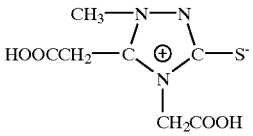
I-32
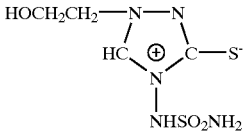
I-33
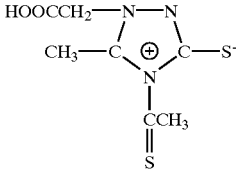
I-34
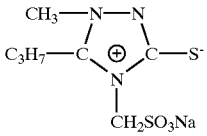
I-35
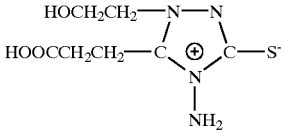
I-36
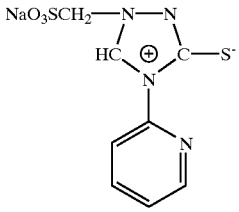
I-37
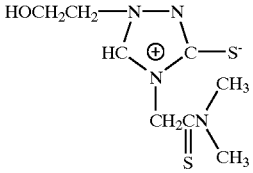
I-38
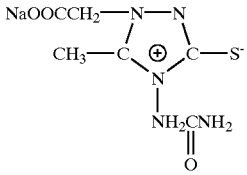
I-39
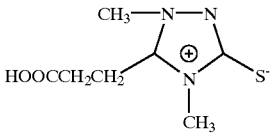

-continued

I-40

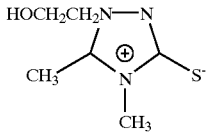

The compounds usable in the present invention represented by the general formula (I) can be synthesized by methods described in H. Heterocyclic Chem. 2, 105 (1965), J. Org. Chem. 32, 2245 (1967), J. Chem. Soc. 3799 (1969), J. P. KOKAI Nos. Sho 60-87322, Sho 60-122936, Sho 60-117240, Hei 4-143757 and the like.

The above-described compound is used in combination with a thiosulfate in the fixing solution or bleach-fixing solution. The molar ratio of this compound to the thiosulfate is 0.05/1 to 0.3/1, preferably 0.07/1 to 0.25/1, and more preferably 0.10/1 to 0.20/1. The amount of this compound which varies depending on the amount of the thiosulfate used is about 0.001 to 0.5 mol/l, preferably 0.05 to 0.3 mol/l.

Two or more of the compounds of the general formula (I) are usable. In such a case, the ratio of the total amount of these compounds to the thiosulfate radical must be in the above-described range.

The details of the bath having the fixing properties in the present invention will be described below.

The processing agent usable in the present invention may be fed in the form of a simple concentrate or a concentrate comprising two or more parts. It may be fed also in the form of a powder, tablets, granules or a paste. Further, it may be fed in the form of the solution usable as it is or in the form of a combination of any of the concentrate, powder, tablets, granuleas, paste and solution-for-direct use.

When the processing agent is in the form of a simple concentrate, it is diluted before the use as the replenisher. The concentrate is preferably set in the developing machine so that it is automatically diluted with water in the replenisher tank. It is preferably that water in the washing water-replanishing tank be used.

In another embodiment, the concentrate is directly fed into the processing tank and water in an amount suitable for the degree of dilution is directly fed into the processing tank. This embodiment is suitable particularly for a compact developing machine having no replenisher tank.

Also the concentrate comprising two or more parts is preferably set in the developing machine so that it is automatically diluted with water in the replenisher tank. It is preferably that water in the washing water-replenishing tank be used. It is also possible that each part is directly fed into the processing tank and then water in an amount suitable for the degree of dilution is directly fed into the tank.

Further, the processing agent in the form of the powder, tablets, granules or paste is preferably directly fed into the processing tank and water in an amount suitable for the degree of dilution is directly fed into the tank. In another preferred embodiment, the processing agent is automatically dissolved and diluted to form the reprenisher in the replenisher tank.

The detailed description of the processing process of the present invention will be given below.

The color developer used for the development of the photographic (photosensitive) material in the present invention is preferably an alkaline aqueous solution containing an aromatic primary amine color developing agent as the main ingredient. The color developing agents include aminophenol compounds and preferably p-phenylenediamine compounds. Typical examples of them include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl) aniline, 4-amino-3-propyl-N-(4-hydroxybutyl)aniline, and sulfates, hydrochlorides and p-toluenesulfonates of them. Among them, particularly preferred are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and hydrochlorides, p-toluenesulfonates and sulfates of them. These compounds are usable also in the form of a combination of two or more of them depending on the purpose.

The amount of the aromatic primary amine developing agent used is preferably 0.0002 to 0.2 mol, more preferably 0.001 to 0.1 mol, per liter of the color developer.

The color developer may contain, in addition to the hydroxylamine or diethylhydroxylamine, a hydroxylamine represented by general formula (I) in J. P. KOKAI No. Hei 3-144446, a sulfite, a hydrazine such as N,N-biscarboxymethylhydrazine, a phenylsemicarbazide, a preservative such as triethanolamine or catecholsulfonic acid, an organic solvent such as ethylene glycol or diethylene glycol, a development accelerator such as benzyl alcohol, polyethylene glycol, quaternary ammonium salt or amine, a dye-forming coupler, a competing coupler, an assistant developing agent such as 1-phenyl-3-pyrazolidone, a thickening agent, a chelating agent typified by an aminopolycarboxylic acid, aminopolyphosphonic acid, alkylphosphonic acid or phosphonocarboxylic acid. The typical examples of the chelating agents include ethylenediaminetetraacetic acid, titrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of them.

Among them, the preservative is most preferably a substituted hydroxylamine such as diethylhydroxylamine, monomethylhydroxylamine or a hydroxylamine having an alkyl group substituted with a water-soluble group, e.g. sulfo, carboxyl or hydroxyl group. The most preferred is N,N-bis(2-sulfoethyl)hydroxylamine, monomethylhydroxylamine or diethylhydroxylamine.

The color developer used in the present invention can contain, if necessary, an antifoggant. The antifoggants usable herein include alkali metal halides such as sodium chloride, potassium bromide and potassium iodide and also organic antifoggants. The organic antifoggants are typified by nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The preferred pH range of the color developer used in the present invention is about 9.5 to 10.5. The pH of the developer in the tank is preferably low so as to inhibit the formation of ammonia gas from the waste solution so far as the developing activity can be kept.

The most preferred pH of the solution in the tank is about 9.9 to 10.4.

Various buffering agents are preferably used for keeping the pH. Examples of the buffering agents include carbonates, phosphates, borates, tetraborates, hydroxybenzoates, glycyl salts, N,N-dimethylglycine salts, leucine salts, norleucine salts, guanine salts, 3, 4-dihydroxyphenylalanine salts, alanine salts, aminobutyrates, 2-amino-2-methyl-1,3-propanediol salts, valine salts, proline salts, trishydroxyaminomethane salts and lysine salts. Carbonates are particularly preferably used.

The amount of the buffering agent to be added to the developer is preferably at least 0.1 mol/l, particularly 0.1 mol/l to 0.4 mol/l.

The chelating agents are preferably biodegradable compounds such as those described in J. P. KOKAI Nos. Sho 63-146998, Sho 63-199295, Sho 63-267750, Sho 63-267751, Hei 2-229146 and Hei 3-186841, German Patent No. 3739610 and European Patent No. 468325.

The color developer in the replenisher tank or processing tank is preferably sielded with a liquid such as a high-boiling organic solvent so as to minimize the contact area with air. The most preferred liquid sielding agent is liquid paraffin. It is particularly suitably used for the replenisher tank.

The processing temperature with the color developer of the present invention is 30 to 55° C., preferably 35 to 55° C. The processing time for the photographic sensitive material is 20 seconds to 5 minutes, preferably 30 seconds to 3 minutes and 20 seconds.

The amount of the replenisher is 30 to 800 ml, preferably 50 to 500 ml, per $m^2$ of the photosensitive material.

When the reversal development is conducted, usually, the black-and-white development is followed by the color development. The black-and-white developer contains a known black-and-white developing agent such as a dihydroxybenzene, e.g. hydroquinone, a 3-pyrazolidone, e.g. 1-phenyl-3-pyrazolidone or an aminophenol, e.g. N-methyl-p-aminophenol either singly or in combination of two or more of them.

The developer used in the present invention can contain a development accelerator, if necessary.

The development accelerators include thioether compounds described in Japanese Patent Publication for Opposition Purpose (hereinafter referred to as "J. P. KOKOKU") Nos. Sho 37-16088, 37-5987, 38-7826, 44-12380 and 45-9019 and U.S. Pat. No. 3,813,247, p-phenylenediamine compounds described in J. P. KOKAI Nos. Sho 52-49829 and 50-15554, quaternary ammonium salts described in J. P. KOKAI No. Sho 50-137726, J. P. KOKOKU No. Sho 44-30074 and J. P. KOKAI Nos. Sho 56-156826 and Sho 52-43429, amine compounds described in U.S. Pat. Nos. 2,494,903, 3,128,182, 4,230,796 and 3,253,919,, J. P. KOKOKU No. Sho 41-11431, and U.S. Pat. Nos. 2,482,546, 2,596,926 and 3,582,346, polyalkylene oxides described in J. P. KOKOKU Nos. Sho 37-16088 and 42-25201, U.S. Pat. No. 3,128,183, J. P. KOKOKU Nos. Sho 41-11431 and 42-23883 and U.S. Pat. No. 3,532,501, as well as 1-phenyl-3-pyrazolidones and imidazoles.

The detailed description will be given on the desilvering steps of the present invention.

The desilvering steps usually comprise various bleaching step, bleach-fixing step and fixing step. An example of these steps is given below, which by no means limit the desilvering steps:

(step 1) bleach-fixing (step 2) bleaching-bleach-fixing (step 3) bleaching-bleach-fixing—fixing (step 4) fixing-bleach-fixing (step 5) bleaching-fixing.

In the present invention, the steps 1, 2, 3 and 4 wherein the bleach-fixing solution is used is preferred. Particularly when a bleach-fixing solution is used in the present invention, the desilvering effect is remarkably improved and the fading resistance of the photosensitive material to light is also improved.

The blelaching agents used for preparing the processing solution having the bleaching function include iron (III) aminopolycarboxylate complexes, persulfates, bromates, hydrogen peroxide and potassium ferricyanide. Among them, the iron (III) aminopolycarboxylate complexes are most preferably used.

In the present invention, the ferric complex may be used in the form of a previously produced iron complex salt to be dissolved or, alaternatively, both of a complex-forming compound and a ferric salt [such as ferric sulfate, ferric chloride, ferric bromide, iron (III) nitrate or iron (III) ammonium sulfate] may be used to form a complex salt in the solution having the bleaching function.

The complex-forming compound can be used in an amount slightly larger than that necessitated for forming the complex with ferric ion. When it is used in an excess amount, the amount is preferably 0.01 to 10% over the stoichiometic amount.

Examples of the compounds capable of forming the ferric complex salt in the solution having the bleaching function in the present invention include ethylenediaminetetraacetic acid (EDTA), 1,3-propanediaminetetraacetic acid (1,3-PDTA), diethylenetriaminepentaacetic acid, 1,2-cyclohexanediaminetetraacetic acid, iminodiacetic acid, methyliminodiacetic acid, N-(2-acetamido)iminodiacetic acid, nitrilotriacetic acid, N-(2-carboxyethyl)iminodiacetic acid, N-(2-carboxymethyl)iminodipropionic acid, β-alaninediacetic acid, 1,4-diaminobutanetetraacetic acid, glycol ether diaminetetraacetic acid, N-(2-carboxyphenyl) iminodiacetic acid, ethylenediamine-N-(2-carboxyphenyl)-N,N',N'-triacetic acid, ethylenediamine-N,N'-disuccinic acid, 1,3-diaminopropane-N,N'-disuccinic acid, ethylenediamine-N,N'-dimalonic acid and 1,3-diaminopropane-N,N'-dimalonic acid. These examples by no means limit the compounds.

The concentration of the ferric complex salt in the processing solution having the bleaching function is suitably 0.005 to 1.0 mol/l, preferably 0.01 to 0.50 mol/l and more preferably 0.02 to 0.30 mol/l in the present invention.

The concentration of the ferric complex salt in the replenisher having the bleaching properties is preferably 0.005 to 2 mol/l, more preferably 0.01 to 1.0 mol/l.

The bath having the bleaching function or the prebath can contain various compounds as the bleaching accelerator.

Preferred are compounds having a high bleaching power such as those having a mercapto group or disulfide bond described in U.S. Pat. No. 3,893,858, German Patent No. 1,290,812, J. P. KOKAI No. Sho 53-95630 and Research Disclosure No. 17129 (July, 1978), thiourea compounds described in J. P. KOKOKU No. Sho 45-8506, J. P. KOKAI Nos. 52-20832 and 53-32735 and U.S. Pat. No. 3,706,561, and halides containing iodine or bromine ion.

The bath having the bleaching function and usable in the present invention can contain a rehalogenating agent such as a bromide (e.g. potassium, sodium or ammonium bromide), chloride (e.g. potassium, sodium or ammonium bromide) or iodide (e.g. ammonium iodide). If necessary, the bath can contain one or more inorganic or organic acids having a pH buffering function such as borax, sodium metaborate, acetic acid, sodium acetate, sodium carbonate, potassium carbonate, phosphorous acid, phosphoric acid, sodium phosphate, citric acid, sodium citrate, tartaric acid, malonic acid, succinic acid and glutaric acid, as well as alkali metal and ammonium salts of them; and a corrosion inhibitor such as ammonium nitrate or guanidine.

The bath having the bleaching function can further contain various fluorescent brighteners, defoaming agents, surfactants and organic solvents such as polyvinylpyrrolidone and methanol.

The fixing components in the bleach-fixing solution and fixing solution are the above-described thiosulfates and compounds of the general formula(I). The thiosulfates include, for example, sodium thiosulfate, potassium thiosulfate and ammonium thiosulfate. They further include known fixing agents; thiocyanates such as sodium thiocyanate and ammmonium thiocyanate; and water-soluble silver halide-dissolving agents such as thioether compounds and thioureas, e.g. ethylenebisthioglycolic acid and 3,6-dithia-1,8-octanediol. They can be used either singly or in the form of a mixture of two or more of them. In the present invention, the thiosulfates, particularly ammonium thiosulfate and sodium thiosulfate are preferably used. The total amount of the fixing agent(s) is preferably in the range of 0.3 to 3 mol, more preferably 0.5 to 2.0 mol, per liter.

To improve the desilvering and image-keeping properties, the processing solution of the present invention having the fixing function preferably contains a compound of the following general formula (II):

(II)

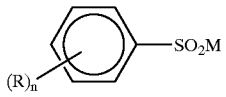

In the above formula, R represents a substituent of the benzene ring, and n represents an integer of 0 to 6. When n is 2 or larger, R's may be the same or different from each other. The substituents are preferably alkyl, substituted alkyl and alkoxy groups having 1 to 3 carbon atoms, hydroxyl group, nitro group, carboxylic acid groups, sulfonic acid groups, halogen atoms, phosphonic acid groups and the like. Examples of the preferred substituents on the alkyl group include hydroxyl group, carboxylic acid group and sulfonic acid group. M represents a hydrogen atom, alkali metal, alkaline earth metal, ammonium or amine. More preferable R is an alkyl or alkoxyl groups having 1 to 3 carbon atoms.

Examples of the preferred compounds are given below, which by no means limit the compounds.

(II-1)

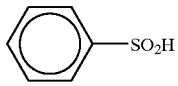

(II-2)

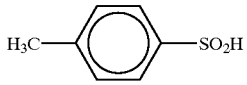

(II-3)

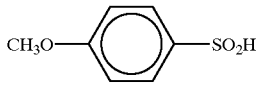

(II-4)

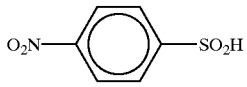

(II-5)

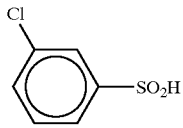

(II-6)

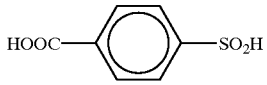

(II-7)

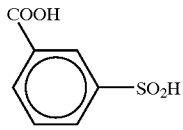

(II-8)

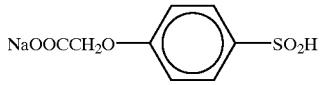

(II-9)

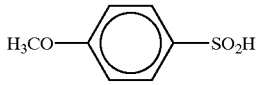

(II-10)

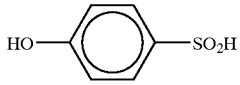

(II-11)

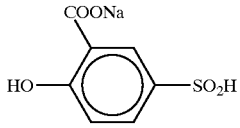

(II-12)

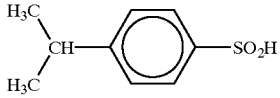

(II-13)

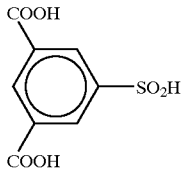

-continued (II-14)

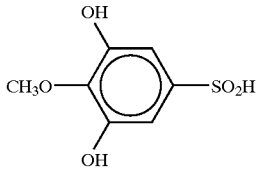

(II-15)

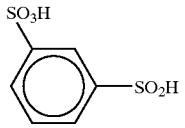

(II-16)

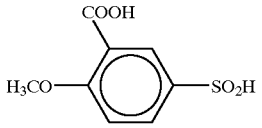

(II-17)

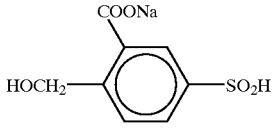

(II-18)

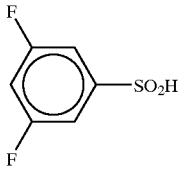

(II-19)

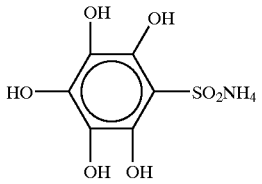

(II-20)

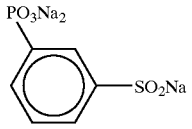

(II-21)

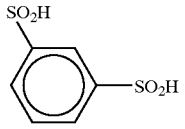

(II-22)

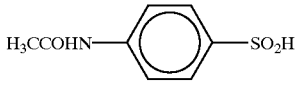

(II-23)

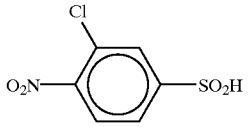

-continued (II-24)

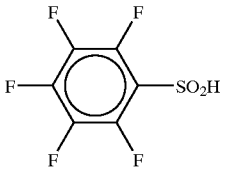

The amount of these compounds is 0.01 to 2 mol, preferably 0.05 to 1 mol, per liter of the processing solution.

The bleach-fixing solution and fixing solution of the present invention desirably contain a sulfite (or hydrogensulfite or metabisulfite) as the preservative particularly in an amount of 0.03 to 0.5 mol/l, more preferably 0.05 to 0.3 mol/l.

The bleach-fixing solution and fixing solution of the present invention contain the sulfite ion-releasing compounds such as the above-described sulfites (such as sodium sulfite, potassium sulfite and ammonium sulfite), bisulfites (such as ammonium bisulfite, sodium bisulfite and potassium bisulfite), metabisulfites (such as potassium metabisulfite, sodium metabisulfite and ammonium metabisulfite) as the preservative and, if necessary, aldehydes (such as benzaldehyde and acetaldehyde), ketones (such as acetone), ascorbic acids, hydroxylamines, benzenesulfinic acids and alkylsulfinic acids.

The bleaching solution, bleach-fixing solution and fixing solution may contain, if necessary, a buffering agent, fluorescent brightener, chelating agent, defoaming agent, antifungal agent, etc.

The pH range of the bleaching solution, bleach-fixing solution and fixing solution used in the present invention is preferably 4 to 8, more preferably 4.5 to 6.5.

The amount of the replenisher for the bleaching solution, bleach-fixing solution and fixing solution used in the present invention is 50 to 2,000 ml per $m^2$ of the photosensitive material. Particularly when the amount of the replenisher for the bath having the fixing function is 100 to 550 ml, the effect of the present invention is remarkable. The washing water (postbath) or overflow from the stabilizing bath may be used as the replenisher, if necessary.

The term "amount of the replenisher" indicates the total amount of the replenishers. The replenishers may include so-called replenisher per se, "concentrate+water" or "solid replenisher+water".

The processing temperature with the blaching solution, bleach-fixing solution and fixing solution is 20 to 50° C., preferably 30 to 45° C. The processing period of time is 10 seconds to 3 minutes, preferably 20 seconds to 2 minutes.

In processing with a processing solution having a bleaching function, it is particularly preferred to conduct aeration so as to keep the photographic properties very stable in the present invention. The aeration can be conducted by a method known in the art, such as blowing of air into the solution having the bleaching effect or absorption of air with an ejector.

In the blowing of air, it is preferred to release air in the solution by means of a diffusing tube having fine pores. Such a type of diffusing tube is widely used for an aeration tank in the treatment of an activated sludge. In the aeration, techniques described on pages BL-1 to BL-2 of Z-121, Using Process C-41 (the third edition) published by Eastman Kodak Co. in 1982 can be employed. In the process of the present invention with the processing solution having bleaching function, vigorous stirring is preferred. For the stirring, contents of J. P. KOKAI No. Hei 3-33847 (from line 6, right upper column to line 2, left lower column, page 8) can be employed as they are.

In the desilvering steps, the stirring is conducted preferably as vigorously as possible by, for example, a method which comprises bumping a jet of the processing solution against the emulsion surface of the photosensitive material as described in J. P. KOKAI No. Sho 62-183460; a method wherein the stirring effect is improved with a rotating means as described in J. P. KOKAI No. Sho 62-183461; a method wherein the photosensitive material is moved while the emulsion surface thereof is brought into contact with a wiper blade placed in the solution so as to make the flow on the emulsion surface turbulent and thereby improving the effect of the stirring; and a method wherein the quantity of the circulating flow of the whole processing solutions is increased. Such a means of making the stirring vigorous is effective for any of the bleaching solution, bleach-fixing solution and fixing solution. Supposedly, the improvement in the stirring effect accelerates the feeding of the bleaching agent and fixing agent into the emulsion membrane, thereby increasing the desilvering speed. The above-described means of improving the stirring effect are more effective when a bleaching accelerator is used. In such a case, the acceleration effect is further improved and the problem of the inhibition of the fixing by the bleaching accelerator can be solved.

An automatic developing machine used for developing the photosensitive material of the present invention preferably has a means of transporting the photosensitive material as described in J. P. KOKAI Nos. Sho 60-191257, 60-191258 and 60-191259. As described in J. P. KOKAI No. Sho 60-191257, such a transportation means remarkably reduces the amount of the processing solution brought from the preceding bath into a subsequent bath, so that the deterioration in the function of the processing solution can be remarkably prevented. Such a function is particularly effective in reducing the processing time in each step and also in reducing the amount of the replenisher.

After the desilvering process, the photosensitive material of the present invention is usually processed in the steps of washing with water and/or stabilization.

The amount of water used in the washing step varies in a wide range depending on the properties of the photosensitive material (which depend on, for example, couplers used), use of this material, temperature of water used for washing, number of the tanks used for washing with water (number of stages), replenishing method such as counter flow or downflow system and various other conditions. Among them, the relationship between the number of the tanks for washing with water and the amount of water in the multi-stage counter flow system can be determined by a method described in "Journal of the Society of Motion Picture and Television Engineers", Vol. 64, pages 248 to 253 (May, 1955). Although the amount of water necessitated for washing can be remarkably reduced by the multi-stage counter flow method described in the above-described literature, another problem is caused in this method that bacteria propagate themselves while water is kept for a longer time in the tanks and, as a result, a suspended matter thus formed is attached to the photosensitive material. For solving this problem, a very effective method which comprises reducing the amount of calcium ion and magnesium ion described in J. P. KOKAI No. Sho 62-288,838 can be employed. Further, this problem can be solved also by using isothiazolone compounds described in J. P. KOKAI No. Sho 57-8,542, thiabendazoles, chlorine-containing germicides such as chlorinated sodium isocyanurates, benzotriazoles and germicides described in Hiroshi Horiguchi "Bokin Bobai-zai no Kagaku (Chemistry for Prevention of Bacteria and Fungi)" published by Sankyo Book Publishing Co. in 1986, "Biseibutsu no Mekkin, Sakkin, Bobai Gijutsu (Technique of Sterilization and Prevention of Microorganisms)" edited by Eisei Gijutsu-kai and published by Kogyo Gijutsu-kai in 1982 and "Bokinbobai-zai Jiten (Dictionary of Steriliers and Antifungal Agents)" edited by Nippon Bokinbobai Gakkai and published in 1986.

The pH of washing water used for processing the photosensitive material of the present invention is 4 to 9, preferably 5 to 8. The temperature of water for washing and the washing time which vary depending on the properties and use of the photosensitive material are usually 15 to 45° C. and 20 seconds to 10 minutes, preferably 25 to 40° C. and 30 seconds to 5 minutes. The photosensitive material of the present invention can be processed directly with a stabilizing solution in place of washing with water. The stabilization can be conducted by any of known processes described in J. P. KOKAI Nos. Sho 57-8543, 58-14834 and 60-220345.

The stabilizing solution contains a compound which stabilizes the color image, selected from among, for example, formalin, benzaldehydes such as m-hydroxybenzaldehyde, formaldehyde/bisulfite adduct, hexamethylenetetramine and derivatives thereof, hexahydrotriazine and derivatives thereof, dimethylolurea, N-methylol compounds such as N-methylolpyrazole, organic acids and pH buffering agents. The preferred amount of these compounds is 0.001 to 0.02 mol per liter of the stabilizing solution. The free formaldehyde concentration in the stabilizing solution is preferably as low as possible so as to prevent formaldehyde gas from sublimation. From such a point of view as above, preferred color image stabilizers are m-hydroxybenzaldehyde, hexamethylenetetramine, N-methylolazoles described in J. P. KOKAI No. Hei 4-270344 such as N-methylolpyrazole and azolylmethylamines described in J. P. KOKAI No. Hei 4-313753 such as N,N'-bis(1,2,4-triazol-1-ylmethyl) piperazine. Particularly preferred is a combination of an azole such as 1,2,4-triazole with an azolylmethylamine such as 1,4-bis(1,2,4-triazol-1-ylmethyl)piperazine or a derivative thereof as described in J. P. KOKAI No. Hei 4-359249 (corresponding to European Patent Unexamined Published Application No. 519190 A 2), since a high image stability and a low formaldehyde vapor pressure are realized by the combination. The stabilizing solution preferably contains, if necessary, an ammonium compound such as ammonium chloride or ammonium sulfite, a metal compound of Bi and Al, a fluorescent whitening agent, a hardener, an alkanolamine described in U.S. Pat. No. 4,786,583, and a preservative which can be contained in also the above-described fixing solution and bleach-fixing solution such as a sulfinic acid compound described in J. P. KOKAI No. Hei 1-231051.

Various surfactants can be incorporated into washing water and/or stabilizing solution so as to prevent the formation of water spots in the course of drying of the photosensitive material. Among them, preferred is an anionic surfactant, particularly an alkylphenol ethylene oxide adduct. The alkylphenols are particularly preferably octyl-, nonyl-, dodecyl- and dinonylphenols. The molar number of ethylene oxide to be added is particularly preferably 8 to 14. It is also preferred to use a silicon surfactant having a high antifoaming effect.

The washing water and/or stabilizing solution preferably contain a chelating agent. Preferred chelating agents include aminopolycarboxylic acids such as ethylenediaminetetraacetic acid and diethylenetriaminepentaacetic acid; organic phosphonic acids such as 1-hydroxyethylidene-1,1-diphosphonic acid, N,N,N'-trimethylenephosphonic acid and diethylenetriamine-N,N,N',N'-tetramethylenephosphonic acid; and hydrolyzates of maleic anhydride polymers described in European Patent No. 345,172 A 1.

The overflow obtained during the washing with water and/or replenishing of the stabilizing solution is reusable in other steps such as the desilvering step.

When each of the above-described processing solutions is concentrated by evaporation in the process with an automatic developing machine, it is preferred to replenish a suitable amount of water, correcting solution or process replenisher in order to compensate the solution for concentration caused by the evaporation. Although the method for replenishing water is not particularly limited, preferred are the following methods: a method described in J. P. KOKAI Nos. Hei 1-254959 and 1-254960 wherein a monitor water tank which is different from the bleaching tank is provided, the amount of water evaporated from the monitor water tank is determined, the amount of water evaporated from the bleaching tank is calculated from the determined amount of evaporated water, and water is replenished into the bleaching tank in proportion to the amount of evaporated water; and a method described in J. P. KOKAI Nos. Hei 3-248155, 3-249644, 3-249645 and 3-249646 wherein the compensation for the evaporation is conducted with a liquid level sensor or overflow sensor. Although water for compensating for the evaporation in each processing solution may be tap water, deionized water or sterilized water preferably used in the above-described water washing steps is preferred.

The description will be made on the photosensitive material usable in the present invention.

Any kind of the photosensitive materials having the transmittant support can be processed by the present invention. Among the photosensitive materials, color negative films and color papers are preferred.

The silver halide emulsions, other substances (such as additives), layers of the photographic structure (such as layer configuration), methods for processing the photosensitive materials, and additives used therefor are preferably those described in the following patents, particularly European Patent No. 0,355,660 A2 (Japanese Patent Application No. Hei 1-107011):

TABLE 1

| Photographic constituent, etc. | J.P. KOKAI No. Sho 62-215272 |
|---|---|
| Silver halide emulsion | From line 6, right upper column, p. 10 to line 5, left lower column, p. 12; and from line 4 from below, right lower column, p. 12 to line 17, left upper column, p. 13 |
| Solvent for silver halide | Lines 6 to 14, left lower column, p. 12; and from line 3 from below, left upper column, p. 13 to the last line, left lower column, p. 18 |
| Chemical sensitizer | Line 3 from below, left lower column, p. 12; line 5 from below, right lower column, p. 12; and from line 1, right lower column, p. 18, to line 9 from below, right upper column, p. 22 |
| Spectral sensitizer (spectral sensitizing method) | From line 8 from below, right upper column, p. 22 to the last line, p. 38 |
| Emulsion stabilizer | From line 1, left upper column, p. 39 to the last line, right upper column, p. 72 |
| Development accelerator | From line 1, left lower column, p. 72 to line 3, right upper column, p. 91 |

TABLE 1-continued

| Photographic constituent, etc. | J.P. KOKAI No. Sho 62-215272 |
|---|---|
| Color coupler (cyan, magenta or yellow coupler) | From line 4, right upper column, p. 91 to line 6, left upper column, p. 121 |
| Color development improver | From line 7, left lower column, p. 121 to line 1, right upper column, p. 125 |

TABLE 2

| Photographic constituent, etc. | J.P. KOKAI No. Sho 62-215272 |
|---|---|
| Ultraviolet absorber | From line 2, right upper column, p. 125 to the last line, left lower column, p. 127 column, p. 127 |
| Decoloration inhibitor (image stabilizer) | From line 1, right lower column, p. 127 to line 8, left lower column, p. 137 |
| High boiling and/or low boiling organic solvent | From line 9, left lower column, p. 137 to the last line, right upper column, p. 144 |
| Dispersion method for photographic additive | From line 1, left lower column to line 7, right upper column, p. 146 |
| Antistaining agent | From line 9, right lower column, p. 188 to line 10, right lower column, p. 193 |
| Surfactant | From line 1, left lower column, p. 201 to the last line, right upper column, p. 210 |
| Fluorine-containing compound (as anti-static agent, coating assistant, lubricant, adhesion inhibitor, etc.) | Line 1, left lower column, p. 210; and line 5, left lower column, p. 222 |

TABLE 3

| Photographic constituent, etc. | J.P. KOKAI No. Sho 62-215272 |
|---|---|
| Binder (hydrophilic colloid) | From line 6, left lower column, p. 222 to the last line, left upper column, p. 225 |
| Thickening agent | From line 1, right upper column, p. 225 to line 2, right upper column, p. 227 |
| Antistatic agent | From line 3, right upper column, p. 227 to line 1, left upper column, p. 230 |
| Hardener | From line 8, right upper column, p. 146 to line 4, left lower column, p. 155 |
| Developing agent precursor | From line 5, left lower column, p. 155 to line 2, right lower column, p. 155 |
| Development inhibitor releasing compound | Lines 3 to 9, right lower column, p. 155 |
| Support | Line 19, right lower column, p. 155; and line 14, left upper column, p. 156 |
| Constitution of photosensitive layers | From line 15, left upper column, p. 156 to line 14, right lower column, p. 156 |
| Dye | From line 15, right lower column, p. 156 to the last line, right lower column, p. 184 |
| Color mixing inhibitor | From line 1, left upper column, p. 185 to line 3, right lower column, p. 188 |
| Gradation controller | Lines 4 to 8, right lower column, p. 188 |
| Polymer latex | From line 2, left upper column, p. 230 to the last line, p. 239 |
| Matting agent | From line 1, left upper colum, p. 240 to the last line, right upper column, p. 240 |
| Photographic process (steps and additives) | From line 7, right upper column, p. 3 to line 5, right upper column, p. 10 |

Notes) The cited portions of J.P. KOKAI No. Sho 62-215272 includes also those amended by the Written Amendment dated March 16, 1987 as stated at the end of this patent publication.

TABLE 3-continued

| Photographic constituent, etc. | J.P. KOKAI No. Sho 62-215272 |
|---|---|

Among the above-described couplers, preferred yellow couplers are so-called short-wave tyoe yellow couplers described in J.P. KOKAI Nos. Sho 63-231451. Sho 63-123047, Sho 63-241547, Hei 1-173499, 1-213648 and 1-250944.

TABLE 4

| Photographic constituent, etc. | J.P. KOKAI No. Hei 2-33144 | EP 0,355,660A2 |
|---|---|---|
| Silver halide emulsion | From line 16, right upper column, p. 28 to line 11, right lower column, p. 29; and lines 2 to 5, p. 30 | From line 53, p. 45 to line 3, p. 47; and lines 20 to 22, p. 47 |
| Chemical sensitizer | From line 12, right lower column, to the last line, p. 29 | Lines 4 to 9, p. 47 |
| Spectral sensitizer (spectral sensitizing method) | Lines 1 to 13, left upper column, p. 30 | Lines 10 to 15, p. 47 |
| Emulsion stabilizer | From line 14, left upper column to line 1, right upper column, p. 30 | lines 16 to 19, p. 47 |
| Color coupler (cyan, magenta or yellow coupler) | From line 14, right upper column, 3 to the last line, 1sft upper column, p. 18; and from line 6, right upper column, p. 30 to line 11, right lower column, p. 35 | Lines 15 to 27, p. 4; from line 30, p. 5 to the last line, p. 28; lines 29 to 31, p. 45; and from line 23, p. 47 to line 50, p. 63 |
| Ultraviolet absorber | From line 14, right lower column, p. 37 to line 11, left upper column, p. 38 | Lines 22 to 31, p. 65 |
| Decoloration inhibitor (image stabilizer) | From line 12, right upper column, p. 36 to line 19, left upper column, p. 37 | From line 30, p. 4 to line 25, p. 45; lines 33 to 40, p. 45; and lines 2 to 21, p. 65 |
| High boiling and/ or low boiling organic solvent | From line 14, right lower column, p. 35 to line 4 from below. left upper column, p. 36 | Lines 1 to 51, p. 64 |
| Dispersion method for photographic additive | From line 10, right lower column, p. 27 to the last line, left upper column, p. 28; and from line 12, right lower column, p. 35 to line 7, right upper column, p. 36 | From line 51, p. 63 to line 56, p. 64 |
| Antistaining agent | The last line, left upper column, p. 37 and line 13, right lower column, p. 37 | From line 32, p. 65 to line 17, p. 66 |

TABLE 5

| Photographic constituent, etc. | J.P. KOKAI No. Hei 2-33144 | EP 0,355,660A2 |
|---|---|---|
| Surfactant | From line 1, right upper column, p. 18 to the last line, right lower column, p. 24; and from line 10 from below, left lower column, p. 27 to line 9, right lower column, p. 27 | — |

TABLE 5-continued

| Photographic constituent, etc. | J.P. KOKAI No. Hei 2-33144 | EP 0,355,660A2 |
|---|---|---|
| Fluorine-containing compound (as antistatic agent, coating assistant, lubricant, adhesion inhibitor, etc.) | Line 1, left upper column, p. 25 to line 9, right upper column, p. 27 | — |
| Binder (hydrohilic colloid) | Lines 8 to 18, right upper column, p. 38 | Lines 23 to 28, p. 66 |
| Support | From line 18, right upper column, p. 38 to line 3, left upper column, p. 39 | From line 29, p. 66 to line 13, p. 67 |
| Constitution of photosensitive layers | Lines 1 to 15, right upper column, p. 28 | Lines 41 to 52, p. 45 |
| Dye | From line 12, left upper column to line 7, right upper column, p. 38 | Lines 18 to 22, p. 66 |
| Color mixing inhibitor | Lines 8 to 11, right upper column, p. 36 | From line 57, p. 64 to line 1, p. 65 |
| Photographic process (steps and aditives | From line 4, left upper column, p. 39 to the last line, left upper column, p. 42 | From line 14, p. 67 to line 28, p. 69 |

Various silver halide emulsions such as silver bromoiodide, silver chloroiodide, silver chlorobromoiodide, silver chlorobromide, silver bromide and silver chloride emulsions are usable in the present invention. The photosensitive material preferably has a layer containing a silver bromoiodide emulsion desirably having an iodine content of about 0.1 to 10 molar %. Although the amount of silver to be used for preparing the coating layers is not particularly limited, it is preferably about 2 to 10 g/M$^2$ and more preferably about 3 to 8 g/m$^2$.

The photosensitive material used in the present invention can contain various couplers. The details are given in Table 2.

Preferred cyan couplers include diphenylimidazole cyan couplers described in J. P. KOKAI No. Hei 2-33144, as well as 3-hydroxypyridine cyan couplers described in European Patent No. 0,333,185 A2 [particularly preferred are a cyan coupler prepared by converting a four-equivalent coupler (42) into a two-equivalent one by introducing a chlorine-linked coupling-off group, and couplers (6) and (9) mentioned therein], and cyclic active methylene cyan couplers described in J. P. KOKAI No. Sho 64-32260 (particularly preferred are Couplers 3, 8 and 34 mentioned therein).

It is preferred that a dye (particularly an oxonol dye) which can be decolored by a process as described on pages 27 through 76 of European Patent No. 0,337,490 A2 is incorporated into the hydrophilic colloid layer in such a manner that the optical reflection density of the photosensitive material will be 0.70 or above at 680 nm in order to improve the sharpness of the image.

The photosensitive material for color photography of the present invention preferably contains a compound for improving the dye image stability as described in European Patent No. 0,277,589 A2 in addition to the coupler, particularly preferably a pyrazoloazole coupler.

To inhibit the staining caused by a dye formed by, for example, the reaction of the color developing agent or an oxidation product thereof remaining in the membrane with the coupler and other side effects during the storage after the process, it is preferred to use a compound (F) which can be chemically bonded with an aromatic amine developing agent remaining after the color development to form a chemically inert, substantially colorless compound and/or a compound (G) which can be chemically bonded with an oxidation product of the aromatic amine color developing agent remaining after the color development to form a chemically inert, substantially colorless compound.

A mildew-proofing agent as described in J. P. KOKAI No. Sho 63-271247 is preferably incorporated into the photosensitive material according to the present invention in order to prevent the propagation of fungi and bacteria in the hydrophilic colloid layer, since they deteriorate the image.

For reducing the amount of the carry-over and also for increasing the recovery of silver, it is desirable that the dry film thickness of the silver halide photosensitive material of the present invention for color photography excluding the support is 25 $\mu$m or below. Particularly, the dry film thickness is preferably about 13 to 23,$\mu$m, and still preferably about 9 to 19 $\mu$m.

The thickness of the film can be reduced by reducing the amount of the gelatin, silver, oil, coupler, etc. The reduction of the amount of gelatin is most preferred. The film thickness can be determined by an ordinary method after leaving the sample to stand at 25° C. at 60 RH % for two weeks.

To improve the stain prevention and image preservation, the degree of swelling of the photographic layers of the silver halide color photographic material used in the invention is preferably 1.5 to 4.0, particularly 1.5 to 3.0. The term "degree of swelling" herein indicates a value obtained by dividing the thickness of the photographic layers after immersing the color photosensitive material in distilled water of 33° C. for 2 minutes by the thickness of the dry photographic layers.

The term "photographic layers" indicates layers composed of at least one photosensitive silver halide emulsion layer laminated with hydrophilic colloid layers, the former layer and the latter layers being water-permeable between each other. The photographic layers do not include a back layer provided on the support on an opposite side to the photographic photosensitive layers. The photographic layers comprise usually two or more layers participating in the formation of a photographic image, namely, a silver halide emulsion layer, intermediate layer, filter layer, antihalation layer and protecting layer.

The degree of swelling can be controlled as described above by any method. For example, it can be controlled by varying the amount and kind of the gelatin and those of the hardener used for the photographic film or by varying the drying conditions and leaving-to-stand conditions after forming the photographic layers. Although gelatin is advantageously used for forming the photographic layers, other hydrophilic colloids are also usable. For example, various synthetic hydrophilic macromolecular substances can be used, such as gelatin derivatives; graft polymers of gelatin and another polymer; proteins such as albumin and casein; cellulose derivatives such as hydroxyethylcellulose, carboxymethylcellulose and cellulose sulfate; saccharide derivatives such as sodium alginate and starch derivatives; and homopolymers or copolymers such as polyvinyl alcohol, partial acetal of polyvinyl alcohol, poly-N-vinylpyrrolidone, polyacrylic acid, polymethacrylic acid, polyacrylamide, polyvinylimidazole and polyvinylpyrazole.

The gelatins usable herein include gelatin treated with lime or an acid, gelatin hydrolyzate and enzymatic decomposition products of gelatin. The gelatin derivatives are obtained by reacting gelatin with a compound selected from among various acid halides, acid anhydrides, isocyanates, bromoacetic acid, alkanesultones, vinylsulfonamides, maleinimide compounds, polyalkylene oxides and epoxy compounds.

The hardening agents include, for example, chromium salts (such as chromium alum and chromium acetate), aldehydes (such as formaldehyde, glyoxal and glutaraldehyde), N-methylol compounds (such as dimethylolurea and methyloldimethylhydantoin), dioxane derivatives (such as 2,3-dihydroxydioxane), active vinyl compounds {such as 1,3,5-triacryloyl-hexahydro-s-triazine, bis(vinylsulfonyl) methyl ether and N,N'-methylenebis-[β-(vinylsulfonyl) propionamide]}, active halogen compounds (such as 2,4-dichloro-6-hydroxy-s-triazine), mucohalogenic acids (such as mucochloric acid and mucophenoxychloric acid), isoxazoles, dialdehyde starch and 2-chloro-6-hydroxytriazinylated gelatin. They can be used either singly or in combination of them.

Particularly preferred hardening agents are the aldehydes, active vinyl compounds and active halogen compounds.

The photosensitive material of the present invention may be exposed to a visible light or infrared light. The exposing method may be either a low illuminance exposure or a high-illuminance short-time exposure. In the latter, a laser scanning exposing method wherein the exposure time per picture element is shorter than 10-4 second is preferred.

In the exposure, a band stop filter described in U.S. Pat. No. 4,880,726 is preferably used in order to remarkably improve the color reproducibility by avoiding the optical color mixing.

The processing method of the present invention can be employed for various photosensitive materials such as color negative films, color reversal films, negative films for movies and positive films for movies. Particularly preferred are color negative films.

The color negative film preferably comprises an emulsion having the above-described halogen composition, and the amount of silver used for coating is preferably as described above.

The color phososensitive material may contain a well-known magnetic recording layer (which is preferably transparent) preferably on the opposite side to the emulsion layer to form, for example, a back layer. It is preferable that the processing method of the present invention be applied to such a color photographic material having the magnetic recording layer, since accuracy of reading of magnetic records increases.

The following Examples will further illustrate the present invention, which by no means limit the invention.

EXAMPLE 1

(1) Starting Material of the Support:

The support used in this Example was prepared as follows: TAC: Triacetylcellulose was prepared by an ordinary solution-flow casting method, i.e., 15 wt % Band method wherein the weight ratio of methylene chloride/methanol was 82/8, TAC concentration was 13%, and plasticizer TPP/BDP was 2/1 (TPP represents triphenyl phosphate and BDP represents biphenyldiphenyl phosphate).

(2) Formation of Undercoat Layer:

Both surfaces of the support prepared as described above were processed by corona discharge. Then an undercoat layer was formed on the surface on a high-temperature side (at the time of stretching) of the support by coating with an undercoat solution having a composition described below. The corona discharge process was conducted with a solid state corona processing machine 6KVA model (a product of Piller Co., Ltd.). The support having 30 cm width was processed at a speed of 20 m/min. From the reading of the current and voltage, 0.375 KV·A·min/$m^2$ process was conducted. In the process, the discharge frequency was 9.6 KHz and the gap clearance between the electrode and dielectric roll was 1.6 mm.

| | |
|---|---|
| gelatin | 3 g |
| distilled water | 250 ml |
| sodium-α-sulfodi-2-ethylhexylsuccinate | 0.05 g |
| formaldehyde | 0.02 g |

An undercoat layer having the following composition was formed on the support TAC:

| | |
|---|---|
| gelatin | 0.2 g |
| salicylic acid | 0.1 g |
| methanol | 15 ml |
| acetone | 85 ml |
| formaldehyde | 0.01 g |

(3) Formation of Back Layer:

The first back layer to the third back layer given below were formed by coating on the surface of the support on which the undercoat layer had been formed.

a) The first back layer:

| | |
|---|---|
| fine powder of Co-containing needle-like γ-iron oxide (in the form of dispersion in gelatin; average particle diameter: 0.08 μm) | 0.2 g/$m^2$ |
| gelatin | 3 g/$m^2$ |
| compound of the following chemical formula 13 | 0.1 g/$m^2$ |
| compound of the following chemical formula 14 | 0.02 g/$m^2$ |
| poly(ethyl acrylate) (average diameter: 0.08 μm) | 1 g/$m^2$ |

$(CH_2{=}CHSO_2NHCH_2CH_2NH)_2{-}CO$

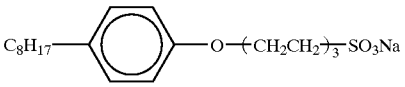

b) The second back layer:

| | |
|---|---|
| gelatin | 0.05 g/$m^2$ |
| conductive material [$S_nO_2/Sb_2O_3$(9:1), particle diameter: 0.15 μm] | 0.16 g/$m^2$ |
| sodium dodecylbenzenesulfonate | 0.05 g/$m^2$ |

c) The third back layer:

| | |
|---|---|
| gelatin | 0.5 g/$m^2$ |
| polymethyl methacrylate (average particle diameter: 1.5 μm) | 0.02 g/$m^2$ |
| cetyl stearate (dispersed in sodium dodecylbenzene sulfonate) | 0.01 g/$m^2$ |
| disodium di(2-ethylhexyl)sulfosuccinate | 0.01 g/$m^2$ |
| compound of the following chemical formula 15 | 0.01 g/$m^2$ |

The back layers thus formed had a coersive force of 960 Oe.

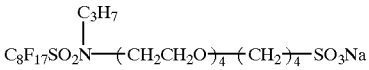

(4) Heat Treatment of Support:

After the formation of the undercoat layer and back layers as described above followed by drying and rolling, the product thus obtained was heat-treated at 110° C. for 48 hours.

(5) Preparation of Photosensitive Layers:

A color negative film as a sample was prepared by forming layers of the following compositions on an undercoated support:

(Compositions of Photosensitive Layers)

Main materials used for forming the layers are classified as follows:

| | |
|---|---|
| ExC: | cyan coupler |
| ExM: | magenta coupler |
| ExY: | yellow coupler |
| ExS: | sensitizing dye |
| UV: | ultraviolet absorber |
| HBS: | high-boiling organic solvent |
| H: | gelatin hardener |

The numerals for the respective components indicate the amount of coating given by g/$m^2$. Those for silver halides are given in terms of silver. Those for sensitizing dyes are given in terms of molar unit per mol of the silver halide contained in the same layer.

| | | |
|---|---|---|
| The first layer (antihalation layer): | | |
| black colloidal silver | silver | 0.09 |
| gelatin | | 1.60 |
| ExM-1 | | 0.12 |
| ExF-1 | | $2.0 \times 10^{-3}$ |
| solid dispersed dye ExF-2 | | 0.030 |
| solid dispersed dye ExF-3 | | 0.040 |
| HBS-1 | | 0.15 |
| HBS-2 | | 0.02 |
| The second layer (intermediate layer): | | |
| silver bromoiodide emulsion M | silver | 0.065 |
| ExC-2 | | 0.04 |
| polyethyl acrylate latex | | 0.20 |
| gelatin | | 1.04 |
| The third layer (low-speed red-sensitive emulsion layer) | | |
| silver bromoiodide emulsion A | silver | 0.25 |
| silver bromoiodide emulsion B | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| gelatin | | 0.87 |
| The fourth layer (medium-speed red-sensitive emulsion layer) | | |
| silver bromoiodide emulsion C | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |

-continued

| | | |
|---|---|---|
| HBS-1 | | 0.10 |
| gelatin | | 0.75 |
| The fifth layer (high-speed red-sensitive emulsion layer) | | |
| silver bromoiodide emulsion D | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| gelatin | | 1.10 |
| The sixth layer (intermediate layer) | | |
| Cpd-1 | | 0.090 |
| solid dispersed dye ExF-4 | | 0.030 |
| HBS-1 | | 0.050 |
| polyethyl acrylate latex | | 0.15 |
| gelatin | | 1.10 |
| The seventh layer (low-speed green-sensitive emulsion layer) | | |
| silver bromoiodide emulsion E | silver | 0.15 |
| silver bromoiodide emulsion F | silver | 0.10 |
| silver bromoiodide emulsion G | silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| gelatin | | 0.73 |
| The eighth layer (medium-speed green-sensitive emulsion layer) | | |
| silver bromoiodide emulsion H | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| gelatin | | 0.80 |
| The ninth layer (high-speed green-sensitive emulsion layer) | | |
| silver bromoiodide emulsion I | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| polyethyl acrylate latex | | 0.15 |
| gelatin | | 1.33 |
| The tenth layer (yellow filter layer) | | |
| yellow colloidal silver | silver | 0.015 |
| Cpd-1 | | 0.16 |
| solid dispersed dye ExF-5 | | 0.060 |
| solid dispersed dye ExF-6 | | 0.060 |
| oil-soluble dye ExF-7 | | 0.010 |

-continued

| | | |
|---|---|---|
| HBS-1 | | 0.60 |
| gelatin | | 0.60 |
| The eleventh layer (low-speed blue-sensitive emulsion layer) | | |
| silver bromoiodide emulsion J | silver | 0.09 |
| silver bromoiodide emulsion K | silver | 0.09 |
| ExS-7 | | $8.6 \times 10^{-4}$ |
| ExS-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| gelatin | | 1.20 |
| The twelfth layer (high-speed blue-sensitive emulsion layer) | | |
| silver bromoiodide emulsion L | silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| gelatin | | 0.70 |
| The thirteenth layer (the first protective layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| gelatin | | 1.8 |
| The fourteenth layer (the second protective layer) | | |
| silver bromoiodide emulsion M | silver | 0.10 |
| H-1 | | 0.40 |
| B-1 (diameter: 1.7 μm) | | $5.0 \times 10^{-2}$ |
| B-2 (diameter: 1.7 μm) | | 0.15 |
| B-3 | | 0.05 |
| S-1 | | 0.20 |
| gelatin | | 0.70 |

Further, the respective layers suitably contain W-1 to W-3, B-4 to B-6, F-1 to F-17, iron salts, lead salts, gold salts, platinum salts, palladium salts, iridium salts and rhodium salts in order to improve the storability, processability, pressure resistance, mildew-proofing and bacteria-proofing properties, antistatic properties and coating easiness.

TABLE 6

| Emulsion | AgI (%) *1 | Coefficient 1 (%) *2 | Diameter (mμ) *3 | Coefficient 2 (%) *4 | Projected (mμ)*5 | D Ratio *6 |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

TABLE 6-continued

| Emulsion | AgI (%) *1 | Coefficient 1 (%) *2 | Diameter (mμ) *3 | Coefficient 2 (%) *4 | Projected (mμ)*5 | D Ratio *6 |
|---|---|---|---|---|---|---|

*1 Average AgI content (%)
*2 Coefficient of variation of AgI content among grains (%)
*3 Average grain diameter (diameter of corresponding sphere) (mμ)
*4 Coefficient of variation of grain diameter (%)
*5 Diameter of projected plane (diameter of corresponding circle) (μm)
*6 Diameter/thickness ratio In Table 6:

(1) The emulsions J to L were reduction-sensitized with thiourea dioxide and thiosulfonic acid in the step of preparation of the grains as described in an Example of J.P. KOKAI No. Hei 2-191938.

(2) The emulsions A to I were sensitized by gold sensitization, sulfur sensitization and selenium sensitization methods in the presence of a spectral sensitizing dye mentioned above for each photosensitive layer and sodium thiocyanate as described in an Example of J.P. KOKAI No. Hei 3-237450.

(3) In the preparation of tabular grains, a low-molecular weight gelatin was used as described in an Example of J.P. KOKAI No. Hei 1-158426.

(4) Dislocation lines as described in J.P. KOKAI No. Hei 3-237450 are obserbed on the tabular grains with a high-voltage electron microscope.

(5) The emulsion L contained double-structure particles each having an internal high-iodine core as described in J. P. KOKAI No. Sho 60-143331.

Preparation of Dispersion of Organic Solid Disperse Dye:

ExF-2 which will be described below was dispersed as follows: 21.7 ml of water, 3 ml of 5% aqueous solution of sodium p-octylphenoxyethoxyethoxyethanesulfonate and 0.5 g of 5% aqueous solution of p-octylphenoxy polyoxyethylene ether (degree of polymerization: 10) were fed into a 700 ml pot mill. 5.0 g of dye ExF-2 and 500 ml of zirconium oxide beads (diameter: 1 mm) were added thereto, and the mixture was milled with a BO type vibration ball mill (a product of Chuo Koki) for 2 hours to obtain a dispersion. Then the dispersion was taken out and added to 8 g of 12.5% aqueous gelatin solution. The beads were removed by filtration to obtain a dispersion of the dye in gelatin. The average diameter of the fine dye grains was 0.44 μm.

A solid dispersion of each of ExF-3, ExF-4 and ExF-6 was obtained in the same manner as that described above. The average diameters of the fine dye grains were 0.24 μm, 0.45 g m and 0.52 μm, respectively. ExF-5 was dispersed by a microprecipitation dispersion method described in Example 1 of European Patent Application Kokai (EP) No. 549,489 A. The average grain diameter was 0.06 m.

ExC-1

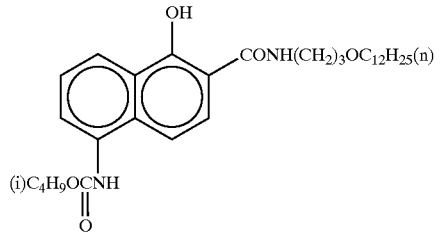

ExC-2

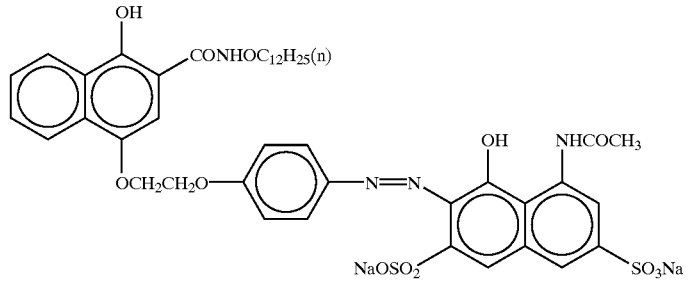

ExC-3

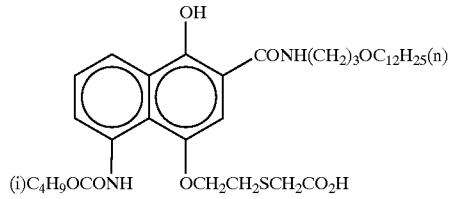

-continued
ExC-4
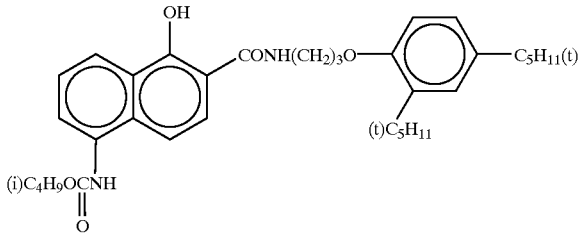
ExC-5
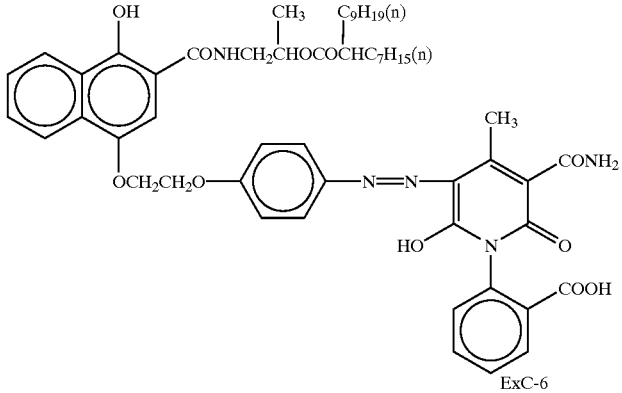
ExC-6
ExC-7
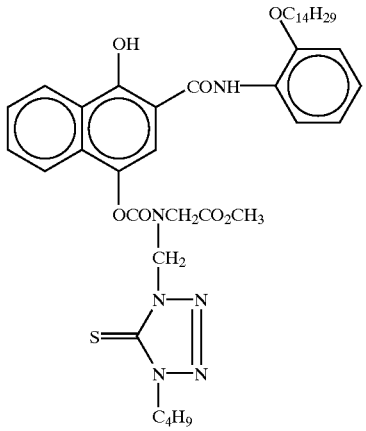
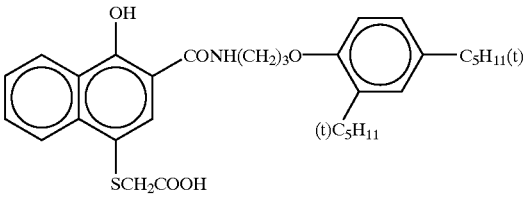
ExC-8
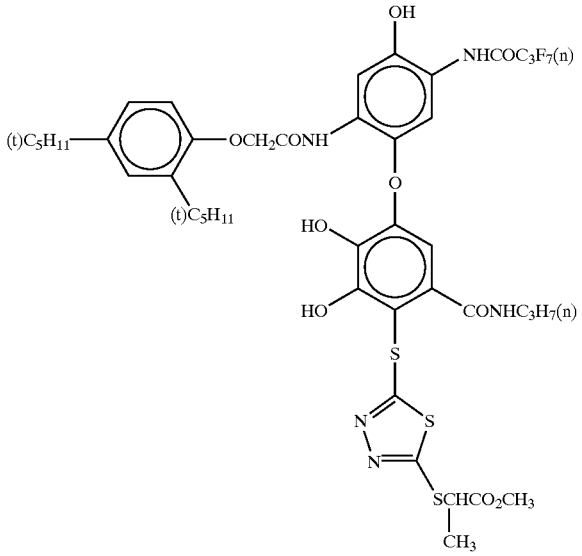

-continued
ExM-1
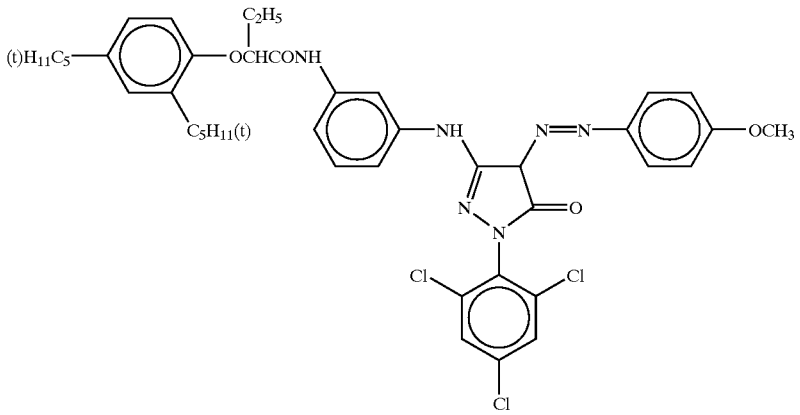
ExM-2
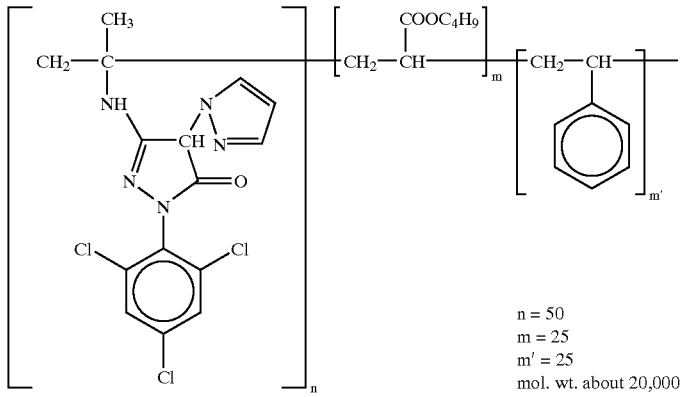
n = 50
m = 25
m' = 25
mol. wt. about 20,000
ExM-3
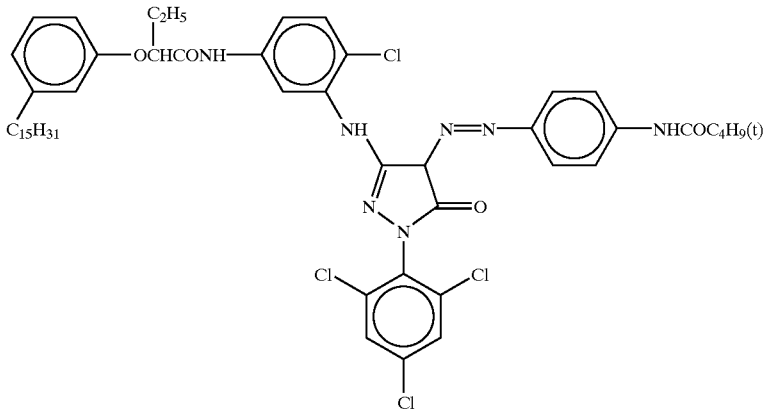
ExM-4
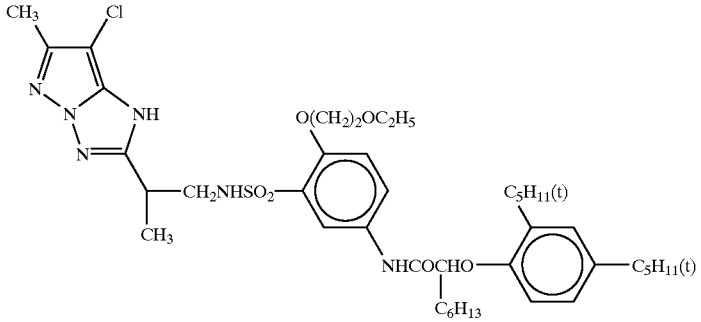

-continued
ExM-5
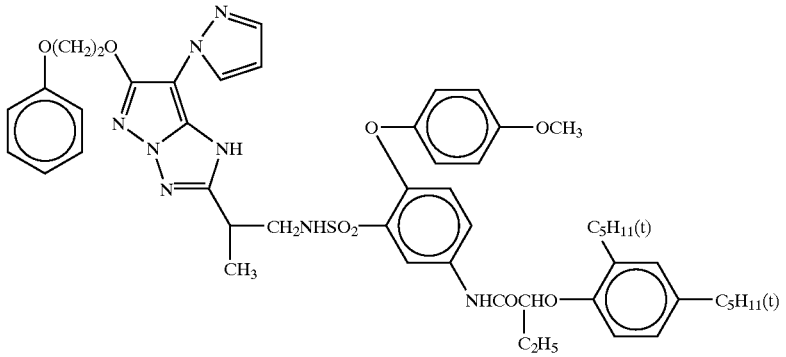
ExY-1
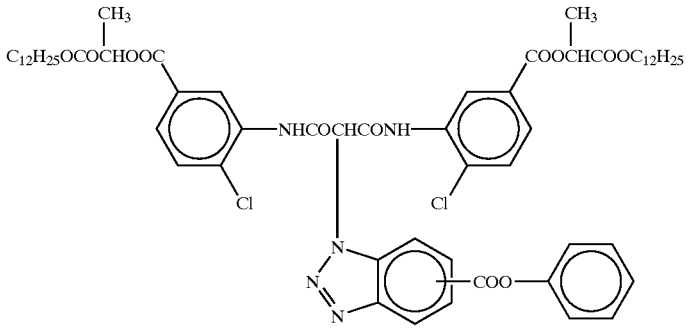
ExY-2
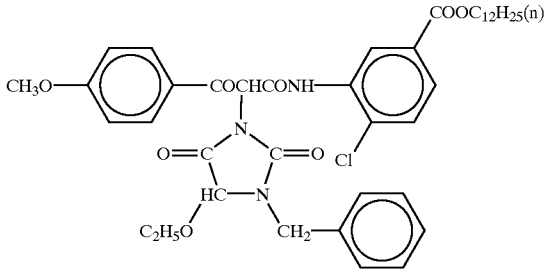
ExY-3
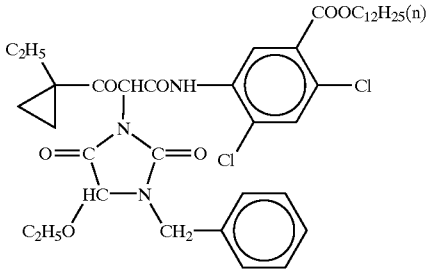
ExY-4
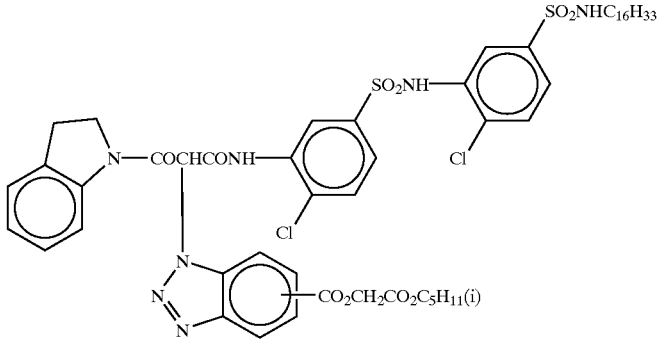

-continued
ExY-5
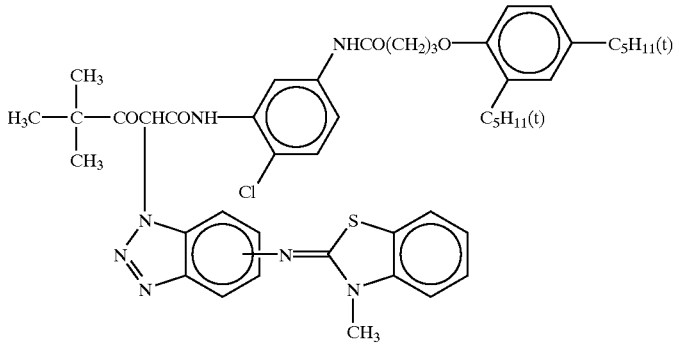
ExF-1
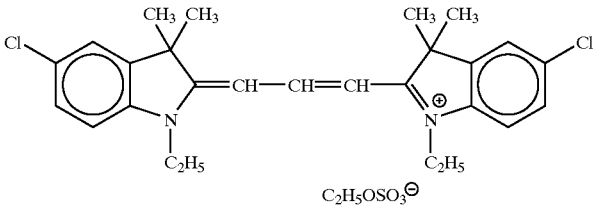
ExF-2
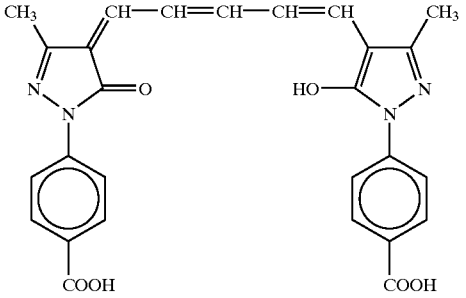
ExF-3
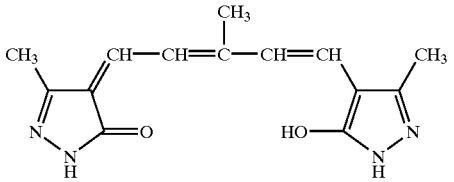
ExF-4
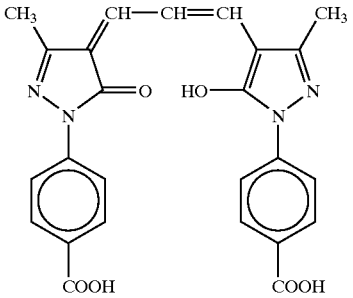
ExF-5
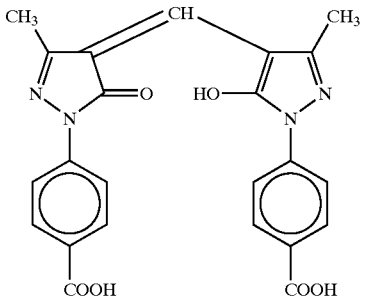
ExF-6
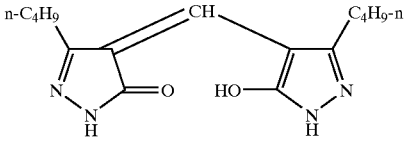
ExF-7
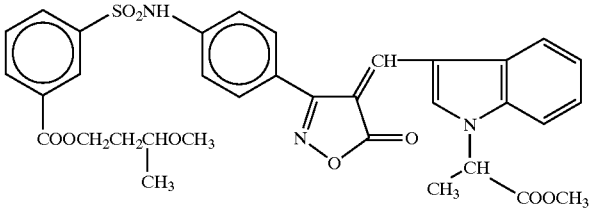

-continued
Cpd-1
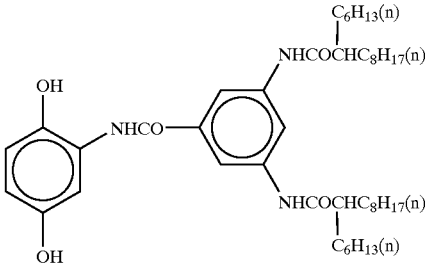
Cpd-2
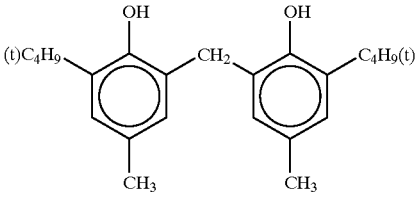
Cpd-3
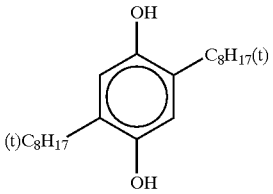
UV-1
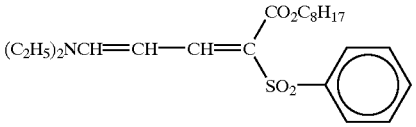
UV-2
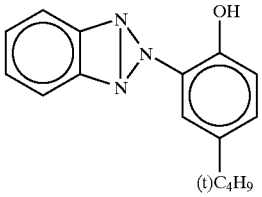
UV-3
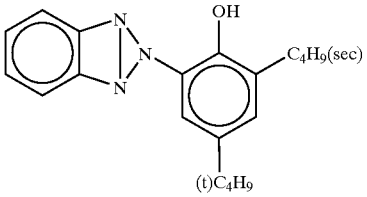
HBS-1
Tricresyl phosphate
HBS-2
Di-n-butyl phthalate
HBS-3
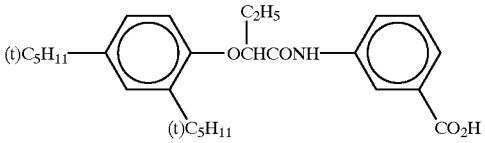
HBS-4
Tri(2-ethylhexyl)phosphate
ExS-1
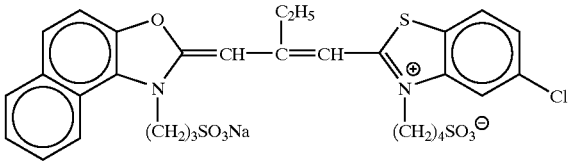
ExS-2
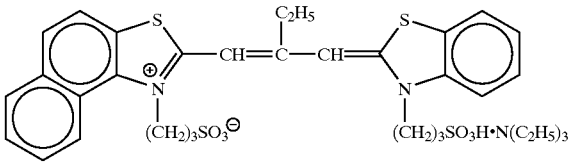
ExS-3
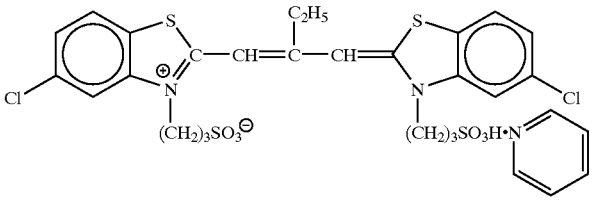

-continued
ExS-4
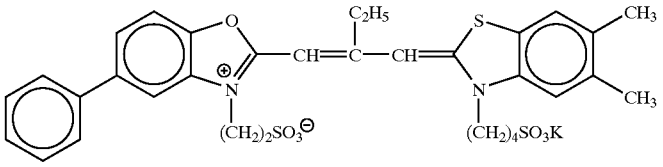
ExS-5
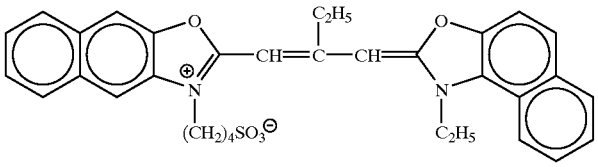
ExS-6
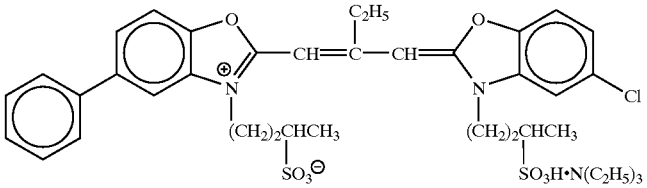
ExS-7
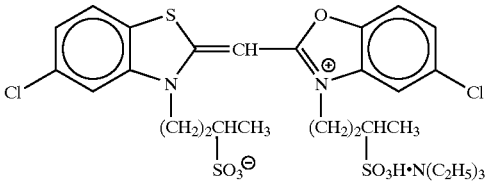
S-1
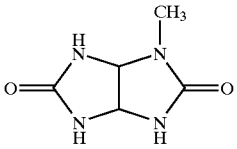
H-1
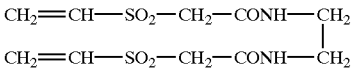
B-1
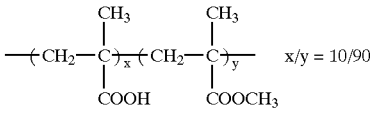
x/y = 10/90
B-2
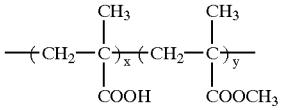
x/y = 40/60
B-3
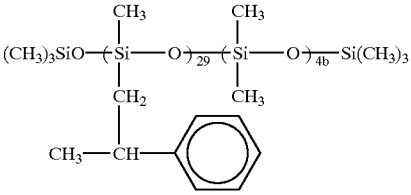
B-4
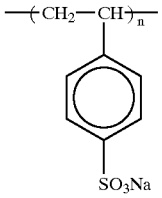
B-5
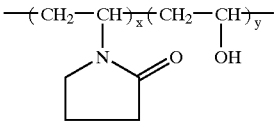
x/y = 70/30
B-6
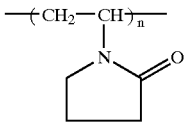
(mol. wt. about 10,000)
W-1
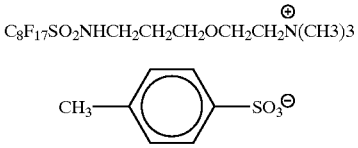
W-2
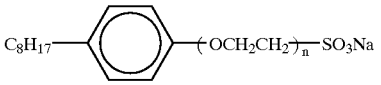
n = 2 ~ 4
W-3
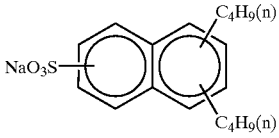

-continued
F-1
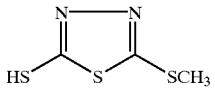
F-2
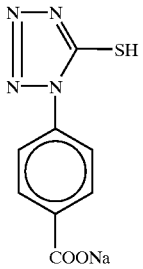
F-3
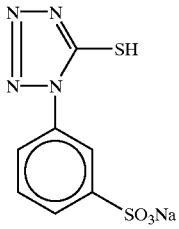
F-4
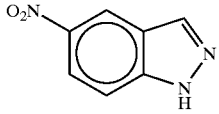
F-5
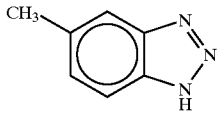
F-6
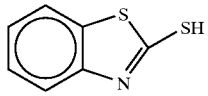
F-7
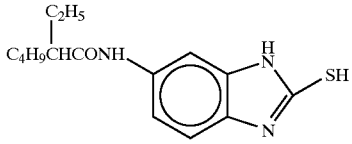
F-8
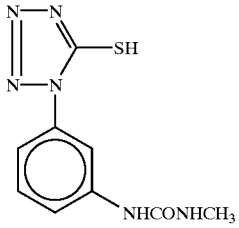
F-9
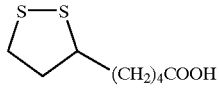
F-10
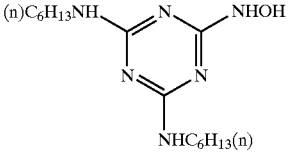
F-11
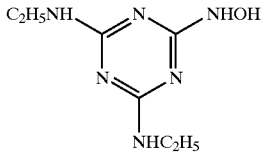
F-12
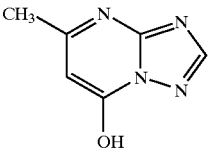
F-13
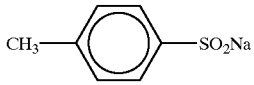
F-14
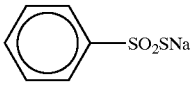
F-15
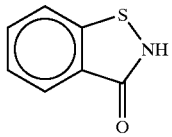
F-16
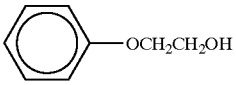
F-17
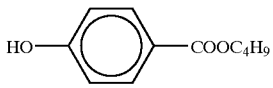

The photosensitive material prepared as described above was cut into pieces having a width of 35 mm and a length of 110 cm.

The details of the process were as described below.

The above-described sample was exposed stepwise (10 cms) at a color temperature of 4800 K, and then processed by the following processing steps with the following processing solutions by means of an automatic developing machine for motion picture film. The additives incorporated into the fixing solution were varied as described below, and the process was conducted therewith.

(Processing Steps)

| (Step) | (Process time) | (Process Temp.) |
|---|---|---|
| Color development | 3 min 15 sec | 38.0° C. |
| Bleaching | 45 sec | 38.0° C. |
| Fixing | 1 min 00 sec | 38.0° C. |
| Stabilization (1) | 20 sec | 38.0° C. |
| Stabilization (2) | 20 sec | 38.0° C. |
| Stabilization (3) | 20 sec | 38.0° C. |
| Drying | 1 min | 55° C. |

* The stabilizer flowed countercurrently from (3) to (1).

The composition of each of the processing liquids was as follows:

| (Color developer) | Tank Solution (g) |
|---|---|
| Diethylenetriaminepentaacetic acid | 5.0 |
| Sodium sulfite | 4.0 |
| Potassium carbonate | 30.0 |
| Potassium bromide | 1.4 |
| Potassium iodide | 1.2 mg |
| Hydroxylamine sulfate | 2.4 |
| N,N-(Disulfonatoethyl)hydroxylamine | 5.0 |
| 4-[N-ethyl-N-(β-hydroxyethyl)amino]-2-methylaniline sulfate | 4.5 |
| Water | ad 1.0 l |
| pH (adjusted with potassium hydroxide and sulfuric acid) | 10.10 |

-continued

| (Bleaching solution) | Tank Solution (g) |
|---|---|
| Ferric ammonium 1,3-diaminopropane-tetraacetate monohydrate | 150.0 |
| 1,3-Diaminopropanetetraacetic acid | 3.0 |
| Ammonium bromide | 100.0 |
| Ammonium nitrate | 17.5 |
| Ammonia water (27%) | 10.0 |
| Acetic acid (98%) | 50.0 |
| potassium carbonate | 10.0 |
| Water | ad 1.0 l |
| pH (adjusted with ammonia water and acetic acid) | 4.3 |

| (Fixing solution) | (unit g) |
|---|---|
| Disodium ethylenediaminetetraacetate | 1.7 |
| Sodium sulfite | 16.0 |
| Sodium hydrogensulfite | 11.0 |
| Aqueous ammonium thiosulfate solution (700 g/l) | see Table 7 |
| Compound of general formula (I) | see Table 7 |
| Ammonium iodide | see Table 7 |
| Silver bromide | 5.0 |
| Water | ad 1.0 l |
| pH | 6.5 |

| (Stabilizer) | (unit g) |
|---|---|
| Surfactant [$C_{10}H_{21}$—O—$(CH_2CH_2O)_{10}$—H] | 1.0 |
| Polymaleic acid (average molecular weight: 2000) | 1.0 |
| 1,2-Benzisothiazoline-3-on | 0.05 |
| Water | ad 1.0 l |
| pH | 8.5 |

The amount of remaining silver in the unexposed part of the sample processed with the fixing solution having a different composition was determined by using fluorescent X rays. After irradiation with 75000 Lux xenone light for 24 hours, the reduction in the density at an exposure point of magenta density of 2.0 was determined. The results are given in Table 7.

TABLE 7

| | Composition of fixing solution | | | | | Amount of remaining | | |
|---|---|---|---|---|---|---|---|---|
| No. | Thiosulfate conc. (mol/l) | Additive conc. (molar ratio) (mol/l) | | | Iodine ion conc. (mol/l) | silver $\mu g/cm^2$ | ΔDG | Remarks |
| 01 | 1.5 | — | — | 0 | 0.01 | 21.3 | 0.24 | Comparative Ex. |
| 02 | 1.45 | I-5 | 0.05 | 0.034 | " | 12.4 | 0.24 | Comparative Ex. |
| 03 | 1.40 | " | 0.10 | 0.071 | " | 3.3 | 0.13 | Present invention |
| 04 | 1.30 | " | 0.20 | 0.15 | " | 1.4 | 0.10 | Present invention |
| 05 | 1.20 | " | 0.30 | 0.25 | " | 1.3 | 0.12 | Present invention |
| 06 | 1.0 | " | 0.50 | 0.50 | " | 10.5 | 0.20 | Comparative Ex. |
| 07 | — | " | 1.50 | 1.00 | " | 25.0 | 0.22 | Comparative Ex. |
| 08 | 1.30 | I-6 | 0.20 | 0.15 | " | 1.6 | 0.11 | Present invention |
| 09 | 1.30 | I-9 | 0.20 | 0.15 | " | 2.0 | 0.12 | Present invention |
| 10 | 1.30 | I-17 | 0.20 | 0.15 | " | 1.9 | 0.13 | Present invention |
| 11 | 1.30 | I-21 | 0.20 | 0.15 | " | 1.8 | 0.13 | Present invention |
| 12 | 1.30 | compound A | 0.20 | 0.15 | " | 24.3 | 0.18 | Comparative Ex. |
| 13 | 1.30 | compound B | 0.20 | 0.15 | " | 22.8 | 0.19 | Comparative Ex. |
| 14 | 1.30 | compound C | 0.20 | 0.15 | " | 25.0 | 0.20 | Comparative Ex. |
| 15 | — | I-1 | 1.50 | 1.00 | " | 24.0 | 0.23 | Comparative Ex. |
| 16 | — | I-2 | 1.50 | 1.00 | " | 22.0 | 0.24 | Comparative Ex. |
| 17 | 1.25 | I-8 | 0.25 | 0.20 | 0 | 1.9 | 0.14 | Present invention |
| 18 | 1.25 | " | 0.25 | 0.20 | 0.002 | 2.0 | 0.14 | Present invention |
| 19 | 1.25 | " | 0.25 | 0.20 | 0.01 | 2.2 | 0.10 | Present invention |
| 20 | 1.25 | " | 0.25 | 0.20 | 0.03 | 2.4 | 0.10 | Present invention |

TABLE 7-continued

| No. | Composition of fixing solution: Thiosulfate conc. (mol/l) | Additive conc. (molar ratio) (mol/l) | | | Iodine ion conc. (mol/l) | Amount of remaining silver $\mu g/cm^2$ | ΔDG | Remarks |
|---|---|---|---|---|---|---|---|---|
| 21 | 1.25 | " | 0.25 | 0.20 | 0.05 | 5.1 | 0.13 | Present invention |
| 22 | 1.5 | — | — | 0 | 0.03 | 29.0 | 0.25 | Comparative Ex. |
| 23 | " | — | — | 0 | 0.05 | 35.5 | 0.26 | Comparative Ex. |

The structures of the comparative compounds A, B and C given in Table 7 are as follows:

Compound A

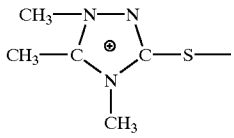

Compound B

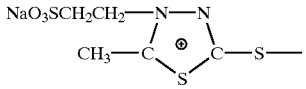

Compound C

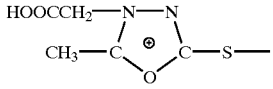

It is apparent from Table 7 that the desilvering (fixing) capacity is excellent and the fading resistance of the magenta dye is improved in the present invention. In particular, the most excellent desilvering properties and fading resistance were obtained when the iodine ion content was in the range of 0.003 to 0.03 mol/l.

EXAMPLE 2

After the imagewise exposure of the sample (photosensitive material) described in Example 1, the continuous process (running test) comprising the steps described below was conducted until the color developer had been replenished in an amount of twice as much as the tank capacity.

In the running test, the bleach-fixing bath had the following composition A, B or C and the amount of the replenisher was changed as shown in Table 8. The processing steps were as follows:

(Processing Steps)

| (Step) | Temp. | Time | Amount of replenisher * |
|---|---|---|---|
| Color development | 45° C. | 90 sec | 260 |
| Bleach-fixing | 40° C. | 90 sec | see Table 8 |
| Stabilization (1) | 40° C. | 15 sec | — |
| Stabilization (2) | 40° C. | 15 sec | — |
| Stabilization (3) | 40° C. | 15 sec | 390 |
| Drying | 75° C. | 30 sec | — |

[Three tanks were used, and the stabilizer flowed countercurrently from (3) to (1).]
* The amount (ml) is given per $m^2$.

The amount of the carry-over from the preceding bath was 60 ml per $m^2$ of the photosensitive material.

The composition of each of the processing solutions was as follows:

| (Color developer) | Solution in tank (g) | Replenisher (g) |
|---|---|---|
| Diethylenetriaminepentaacetic acid | 4.0 | 4.0 |
| Disodium 4,5-dihydroxybenzene-1,3-disulfonate | 0.5 | 0.5 |
| Sodium sulfite | 4.0 | 8.0 |
| Potassium carbonate | 38.0 | 38.0 |
| Potassium bromide | 4.0 | — |
| Potassium iodide | 1.3 mg | — |
| N,N-di(sulfonatoethyl)hydroxylamine | 5.0 | 10.0 |
| 2-Methyl-4-[N-ethyl-N-(β-hydroxyethyl)-amino]aniline sulfate | 10.0 | 22.0 |
| Water | ad 1.0 l | 1.0 l |
| pH (with potassium hydroxide and sulfuric acid) | 10.05 | 10.40 |

| (Bleaching-fixing solution A) (Comp. Ex.) | Solution in tank (g) | Replenisher (g) |
|---|---|---|
| Ethylenediamine-(2-carboxyphenyl)-N,N',N'-triacetic acid | 0.10 mol | 0.12 mol |
| Ethylenediaminetetraacetic acid | 0.06 mol | 0.08 mol |
| Ferric chloride | 0.16 mol | 0.18 mol |
| Ammonium thiosulfate | 1.5 mol | 1.6 mol |
| Ammonium iodide | 1.0 | — |
| Ammonium sulfite | 10.0 | 40.0 |
| Succinic acid | 12.0 | 12.0 |
| Water | ad 1.0 l | 1.0 l |
| pH (with nitric acid and ammonia water) | 5.5 | 5.0 |

| (Bleaching-fixing solution B) (Comp. Ex.) | Solution in tank (g) | Replenisher (g) |
|---|---|---|
| Ethylenediamine-(2-carboxyphenyl)-N,N',N'-triacetic acid | 0.10 mol | 0.12 mol |
| Ethylenediaminetetraacetic acid | 0.06 mol | 0.08 mol |
| Ferric chloride | 0.16 mol | 0.18 mol |
| Compound I-1 | 1.5 mol | 1.6 mol |
| Ammonium iodide | 1.0 | — |
| Ammonium sulfite | 10.0 | 40.0 |
| Succinic acid | 12.0 | 12.0 |
| Water | ad 1.0 l | 1.0 l |
| pH (with nitric acid and ammonia water) | 5.5 | 5.0 |

| (Bleaching-fixing solution C) (present invention) | Solution in tank (g) | Replenisher (g) |
|---|---|---|
| Ethylenediamine-(2-carboxyphenyl)-N,N',N'-triacetic acid | 0.10 mol | 0.12 mol |
| Ethylenediaminetetraacetic acid | 0.06 mol | 0.08 mol |
| Ferric chloride | 0.16 mol | 0.18 mol |
| Compound I-1 | 0.25 mol | 0.30 mol |
| Ammonium thiosulfate (pure) | 1.25 | 1.30 |
| Ammonium iodide | 1.0 | — |
| Ammonium sulfite | 10.0 | 40.0 |
| Succinic acid | 12.0 | 12.0 |
| Water | ad 1.0 l | 1.0 l |
| pH (with nitric acid and ammonia water) | 5.5 | 5.0 |

| (Stabilizer) (common to the solution in the tank and replenisher) (unit: g) | |
|---|---|
| Polyoxyethylene-p-monononylphenyl ether (average degree of polymerization: 10) | 0.2 |

-continued

| | |
|---|---|
| Chlorinated sodium isocyanurate | 0.02 |
| Deionized water (dielectric constant: 5 μs/cm or below) | 1000 ml |
| pH | 6.5 |

The iodine ion concentration in each bleach-fixing solution in the running equilibrium was analyzed by ion chromatography. Then the sample was exposed (10 MCM) through a wedge and processed with the processing solution which had reached the running equilibrium. The amount of silver remaining in the maximum-concentration part of the processed sample was determined with fluorescent X-rays. The fading of magenta by light was determined in the same manner as that of Example 1. The results are given in Table 8.

TABLE 8

| Bleach-fixing solution | | | | Amount of | | |
|---|---|---|---|---|---|---|
| Kind | | Amount of replenisher (ml/m$^2$) | Iodine ion conc. (mol/l) | remaining silver (μg/cm$^2$) | ΔDG | Remarks |
| 31 | A | 65 | 0.021 | 29.7 | 0.27 | Comp. Ex. |
| 32 | A | 130 | 0.011 | 27.5 | 0.26 | " |
| 33 | A | 260 | 0.006 | 23.9 | 0.25 | " |
| 34 | A | 390 | 0.004 | 21.1 | 0.24 | " |
| 35 | A | 520 | 0.003 | 19.9 | 0.23 | " |
| 36 | A | 650 | 0.002 | 16.8 | 0.23 | " |
| 37 | B | 65 | 0.021 | 35.6 | 0.26 | " |
| 38 | B | 130 | 0.011 | 30.5 | 0.25 | " |
| 39 | B | 260 | 0.006 | 23.6 | 0.24 | " |
| 40 | B | 390 | 0.004 | 19.8 | 0.24 | " |
| 41 | B | 520 | 0.003 | 17.9 | 0.23 | " |
| 42 | B | 650 | 0.002 | 15.8 | 0.22 | " |
| 43 | C | 65 | 0.021 | 4.1 | 0.11 | Present invention |
| 44 | C | 130 | 0.011 | 1.8 | 0.11 | Present invention |
| 45 | C | 260 | 0.006 | 1.9 | 0.10 | Present invention |
| 46 | C | 390 | 0.004 | 2.0 | 0.11 | Present invention |
| 47 | C | 520 | 0.003 | 2.3 | 0.12 | Present invention |
| 48 | C | 650 | 0.002 | 5.0 | 0.15 | Present invention |

The bleach-fixing solution C of the present invention containing both thiosulfate radical and compound of the general formula (I) of the present invention had remarkably improved desilvering properties and fading resistance to light. The most excellent results were obtained when the amount of the replenisher was in the range of 100 to 550 ml/m$^2$.

EXAMPLE 3

The running process was conducted under the same conditions as those in No. 44 of Example 2 except that the compound I-1 was replaced with I-2, I-5, I-6 and I-8 to obtain excellent desilvering properties and fading resistance to light.

EXAMPLE 4

The running test was conducted under the same conditions as those in No. 33, 39 or 45 of Example 2 except that the composition of the bleach-fixing solution was changed as described below.

(Bleach-Fixing Solution A1)

The same as the bleach-fixing solution A except that 0.15 mol/l of the compound II-2 was added to the solution in the tank and replenisher thereof.

(Bleach-fixing Solution A2)

The same as the bleach-fixing solution A except that 0.15 mol/l of the compound II-3 was added to the solution in the tank and replenisher thereof.

(Bleach-Fixing Solution B1)

The same as the bleach-fixing solution B except that 0.15 mol/l of the compound II-2 was added to the solution in the tank and replenisher thereof.

(Bleach-Fixing Solution B2)

The same as the bleach-fixing solution B except that 0.15 mol/l of the compound II-3 was added to the solution in the tank and replenisher thereof.

(Bleach-Fixing Solution C1)

The same as the bleach-fixing solution C except that 0.15 mol/l of the compound II-2 was added to the solution in the tank and replenisher thereof.

(Bleach-Fixing solution C2)

The same as the bleach-fixing solution C except that 0.15 mol/l of the compound II-3 was added to the solution in the tank and replenisher thereof.

The desilvering properties and fading resistance to light were evaluated in the same manner as that of Example 2 to obtain the results given in Table 9.

TABLE 9

| Bleach-fixing solution | | | | Amount of | | |
|---|---|---|---|---|---|---|
| Kind | | Amount of replenisher (ml/m$^2$) | Iodine ion conc. (mol/l) | remaining silver (μg/cm$^2$) | ΔDG | Remarks |
| 50 | A | 260 | 0.006 | 23.9 | 0.25 | Comp. Ex. |
| 51 | A1 | 260 | 0.006 | 24.5 | 0.26 | " |
| 52 | A2 | 260 | 0.006 | 25.9 | 0.25 | " |
| 53 | B | 260 | 0.006 | 23.6 | 0.24 | " |
| 54 | B1 | 260 | 0.006 | 26.5 | 0.26 | " |
| 55 | B2 | 260 | 0.006 | 27.9 | 0.25 | " |
| 56 | C | 260 | 0.006 | 1.9 | 0.10 | Present invention |
| 57 | C1 | 260 | 0.006 | 0.5 | 0.08 | Present invention |
| 58 | C2 | 260 | 0.006 | 0.9 | 0.08 | Present invention |

The desilvering properties and fading resistance of magenta to light are improved by the present invention. In particular, the most preferred results are obtained when the bleach-fixing solution containing the preferred compound of the general formula (II) of the invention is used.

According to the present invention, an image having excellent fixing properties and fading resistance to light can be obtained.

These effects can be effectively obtained even when the iodine ion concentration in the fixing solution or bleach-fixing solution is high.

What is claimed is:

1. A method of processing a silver bromoiodide color photographic material which comprises the steps of color-developing an image-wise exposed silver bromoiodide color photographic material and subjecting the developed material to desilvering in a processing bath having a fixing function and containing a thiosulfate compound and a compound of the following general formula (I) in a molar ratio of 1/0.05 to 1/0.30:

(I)

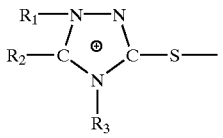

wherein $R_1$, $R_2$ and $R_3$ each represent a hydrogen atom or an alkyl group having 1 to 3 carbon atoms, with the proviso that at least one of $R_1$, $R_2$ and $R_3$ is an alkyl group substituted with a water-soluble group selected from the group consisting of sulfonic acid group and carboxylic acid group, and that both $R_1$ and $R_3$ cannot be hydrogen atom at the same time and the total number of carbon atoms in $R_1$, $R_2$ and $R_3$ is 2 to 6, wherein an amount of the compound of the formula (I) is about 0.05 to 0.3 mol/l and an amount of thiosulfate compound is 0.3 to 3 mol/l in an aqueous solution of the bath.

2. The method of claim 1 wherein the bath having the fixing function contains 0.003 to 0.03 mol/l of iodine ion.

3. The method of claim 1 wherein the bath having the fixing function is a bleach-fixing bath.

4. The method of claim 1 wherein an amount of replenishing solution to the bath is 100 to 550 ml relative to 1 $m^2$ of the processed photographic material.

5. The method of claim 1 wherein the silver bromoiodide photographic material has a magnetic recording layer.

6. A method of processing a silver bromoiodide color photographic material which comprises the steps of color-developing an image-wise exposed silver bromoiodide color photographic material and subjecting the developed material to desilvering in a processing bath having a fixing function and containing a thiosulfate compound and a compound of the following general formula (I) in a molar ratio of 1/0.05 to 1/0.30, and a compound of the following general formula (II):

(I)

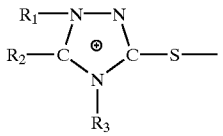

wherein $R_1$, $R_2$ and $R_3$ each represent a hydrogen atom or an alkyl group having 1 to 3 carbon atoms, with the proviso that at least one of $R_1$, $R_2$ and $R_3$ is an alkyl group substituted with a water-soluble group selected from the group consisting of a sulfonic acid group and a carboxylic acid group and that both $R_1$ and $R_3$ cannot be a hydrogen atom at the same time, and the total number of carbon atoms in $R_1$, $R_2$ and $R_3$ 2 to 6, (II)

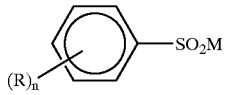

wherein R represents a substituent of benzene ring, n represents an integer of 0 to 6, and M represents a hydrogen atom, alkali metal, alkaline earth metal, ammonium or amine, wherein an amount of the compound of formula (I) is about 0.05 to 0.3 mol/l and an amount of the compound of formula (II) is about 0.01 to 2 mol/l and an amount of thiosulfate compound is 0.3 to 3 mol/l in an aqueous solution of the bath.

7. The method of claim 6 wherein the substituent of benzene ring is an alkyl group having 1 to 3 carbon atoms, substituted alkyl and alkoxy groups, hydroxyl group, nitro group, carboxylic acid group, sulfonic acid group, halogen atom and phosphonic acid group.

8. The method of claim 6 wherein the substituent of benzene ring is an alkyl group or alkoxy group having 1 to 3 carbon atoms.

9. The method of claim 6 wherein the bath having the fixing function contains 0.003 to 0.03 mol/l of iodine ion.

10. The method of claim 1, wherein the compound of formula (I) is:

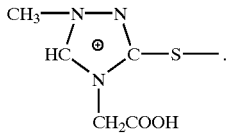

11. The method of claim 6, wherein the compound of formula (II) is:

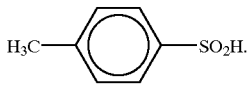

* * * * *